US010734187B2

(12) United States Patent
Maltz

(10) Patent No.: US 10,734,187 B2
(45) Date of Patent: Aug. 4, 2020

(54) TARGET ASSEMBLY, APPARATUS INCORPORATING SAME, AND METHOD FOR MANUFACTURING SAME

(71) Applicant: UIH-RT US LLC, Concord, CA (US)

(72) Inventor: Jonathan S. Maltz, Concord, CA (US)

(73) Assignee: UIH-RT US LLC, Walnut Creek, CA (US)

( * ) Notice: Subject to any disclaimer, the term of this patent is extended or adjusted under 35 U.S.C. 154(b) by 109 days.

(21) Appl. No.: 15/815,659

(22) Filed: Nov. 16, 2017

(65) Prior Publication Data

US 2019/0148102 A1 May 16, 2019

(51) Int. Cl.
*H01J 35/12* (2006.01)
*H01J 35/18* (2006.01)

(52) U.S. Cl.
CPC ..... *H01J 35/12* (2013.01); *H01J 35/18* (2013.01); *H01J 2235/1013* (2013.01); *H01J 2235/1204* (2013.01)

(58) Field of Classification Search
None
See application file for complete search history.

(56) References Cited

U.S. PATENT DOCUMENTS 3,867,638 A * 2/1975 Golden ..... G01T 1/29 250/252.1
4,104,531 A * 8/1978 Weiss ..... A61B 6/145 378/121
5,471,516 A * 11/1995 Nunan ..... A61N 5/1049 378/124
5,781,608 A * 7/1998 Tomie ..... H05G 2/001 378/119
5,949,836 A 9/1999 Lidsky et al.
7,831,021 B1 * 11/2010 Schumacher ..... H05G 2/00 378/143
2006/0280290 A1 12/2006 Matsumura et al.
2011/0051899 A1 3/2011 Schumacher et al.

FOREIGN PATENT DOCUMENTS

RU 2310296 C1 11/2007

OTHER PUBLICATIONS

E. Gulbransen et al. "Kinetics of oxidation of pure tungsten, 1150-1615 C", Journal of the Electrochemical Society, 1(111): 103-109 (1964).
H. Jehn et al. "Iridium losses during oxidation", Platinum Metals Review, 3(22): 92-97(1978).
D. Wells et al. "'Cabinet-safe' study of 1-8 MeV electron accelerators", Nuclear Instruments and Methods in Physics Research Section A: Accelerators, Spectrometers, Detectors and Associated Equipment, 1-2(463):118-128(2001).

(Continued)

*Primary Examiner* — Hoon K Song
(74) *Attorney, Agent, or Firm* — Metis IP LLC

(57) ABSTRACT

A target assembly for generating radiation may comprise a target, a substrate and a window. The target may be capable of generating first radiation when impinged by a beam. The window may be at least partially permeable to the beam. The window and the substrate may form at least part of a hermetically sealed chamber and the target may be positioned in the chamber. The chamber may be filled with air having a normal or reduced content of oxygen.

6 Claims, 14 Drawing Sheets

(56) References Cited

OTHER PUBLICATIONS

C. A. Krier, "Coatings for the protection of refractory metals from oxidation". DTIC Document, Tech. Rep., 1961.
N. Ayzatsky et al. "Target complex for isotope production on the electron accelerator", in Proceedings of RuPAC 2008, Zvenigorod, Russia, 2008.
E. M. Passmore et al. "Investigation of Diffusion Barriers for Refractory Metals", Technical Documentary Report NR ASD-TDR-62-432, Jul. 1962.

* cited by examiner

300

TARGET ASSEMBLY, APPARATUS INCORPORATING SAME, AND METHOD FOR MANUFACTURING SAME

TECHNICAL FIELD

The present invention generally relates to radiation apparatuses, and more specifically to target assemblies, radiation apparatuses incorporating same, and methods for manufacturing same.

BACKGROUND

Linear accelerators and X-ray tubes are widely used in fields including medicine, non-destructive testing (NDT), security inspection, etc. Both a linear accelerator and an X-ray tube may employ a bremsstrahlung converter (BCs) to generate X-ray radiation from incident charged particles. As the charged particles are slowed inside the BC, X-ray photons may be generated. A BC may be referred to as an X-ray target or simply target. A target, often packaged in a target assembly, may be made of a material having a high atomic weight and a high melting point, such as tungsten (W), rhenium, tantalum (Z), etc. During the bremsstrahlung process, incident charged particles may deposit such a significant amount of their kinetic energy in the target that the target material and the target assembly may become hot or even melt. The hot target material may become oxidized if it is exposed to air, and the produced volatile oxides may vaporize at the working temperature of the target. In a conventional linear accelerator or X-ray tube, the target may reside within a vacuum chamber or a chamber filled with a non-reactive gas, or be directly exposed to the ambient air. A target assembly with the target residing in a vacuum or in a non-reactive gas atmosphere may be complicated to manufacture, while a target directly exposed to the ambient air may suffer from a reduced lifespan due to oxidation corrosion at its working temperature. Accordingly, there is a need for a target assembly that may provide an efficient protection and cooling for a target packaged therein and be convenient to manufacture.

SUMMARY

According to an aspect of the present disclosure, a target assembly for generating radiation may comprise a target, a substrate and a window. The target may be capable of generating first radiation when impinged by a beam. The window may be at least partially permeable to the beam. The window and the substrate may form at least part of a hermetically sealed chamber and the target may be positioned in the chamber. The chamber may be filled with air having a normal or reduced content of oxygen.

In some embodiments, the target assembly may further comprise a second target capable of generating second radiation when impinged by the beam. The second radiation and the first radiation may be different in frequency or intensity.

In some embodiments, the substrate may include a cavity, and the cavity may provide a space for holding at least a portion of the target.

In some embodiments, the window may provide a space for holding at least a portion of the target.

According to another aspect of the present disclosure, a radiation generator for generating radiation may comprise an envelope, a beam generator, and a target assembly. The envelope may be of substantial vacuum. The beam generator may generate a beam, and be positioned inside the envelope. The target assembly may generate radiation. The target assembly may comprise a target, a substrate and a window. The target may be capable of generating first radiation when impinged by a beam. The window may be at least partially permeable to the beam. The window and the substrate may form at least part of a hermetically sealed chamber and the target may be positioned in the chamber. The chamber may be filled with air having a normal or reduced content of oxygen.

In some embodiments, the radiation generator may further comprise a carrier for supporting the target assembly.

In some embodiments, a surface of the target assembly and a surface of the carrier may together form a tube for holding a cooling medium to cool the target assembly.

In some embodiments, the radiation generator may further include a second radiation module on the carrier. The second radiation module may be configured to generate second radiation when impinged by the beam. The second radiation and the first radiation may be different in frequency or intensity.

In some embodiments, the beam may propagate along a beam path. The carrier may be movable so that the radiation generator is switchable between a first radiation mode and a second radiation mode by moving the carrier. In the first radiation mode, the target assembly may be in the beam path. In the second radiation mode, the second radiation module may be in the beam path.

In some embodiments, the radiation generator may further comprise a beam director. The beam director may be configured to switch a path of the beam between a first path and a second path by turning a direction of the beam. The beam may reach the target assembly when propagating along the first path. The beam may reach the second generation module when propagating along the second path.

In some embodiments, the target assembly may be positioned outside the vacuum envelope.

According yet to another aspect of the present disclosure, a method for manufacturing a target assembly may comprise providing a substrate. The method may also comprise positioning a target on the substrate, and the target plate may be capable of generating radiation when impinged by a beam. The method may further comprise installing a window plate onto the substrate under the atmospheric air to build a preliminary target assembly. The window plate and the substrate may form at least part of a hermetically sealed chamber and the window plate may be at least partially permeable to the beam. The method may further comprise heating the preliminary target assembly to a temperature approximate to a proposed working temperature of the target assembly.

In some embodiments, the installing the window plate onto the substrate under the atmospheric air may include causing the window plate to curve away from the substrate and installing the curved window plate onto the substrate under a prevailing environmental condition. The chamber formed by the window plate and the cavity may contain ambient air.

In some embodiments, the causing the window plate to curve away from the substrate may include applying a negative pressure to a surface of the window plate.

In some embodiments, the prevailing environmental condition may be approximate to the standard temperature and pressure.

In some embodiments, the proposed working temperature of the target assembly may be over 1100 degrees Celsius.

In some embodiments, the installing of the window plate is without vacuuming air.

According yet to another aspect of the present disclosure, a target assembly for generating radiation may comprise a target, a substrate and a window. The target may connect with the substrate, and may be capable of generating first radiation when impinged by a beam. The window may be at least partially permeable to the beam, and may hermetically seal the target in a chamber without vacuuming air from the chamber.

According yet to another aspect of the present disclosure, a target assembly for generating radiation may comprise a target, a substrate and a window. The target may be supported on the substrate, and may be capable of generating first radiation when impinged by a beam. The window may be at least partially permeable to the beam, and may hermetically seal at least a portion of the target in a chamber without vacuuming air from the chamber. The chamber may be formed by the window and the target.

In some embodiments, the chamber may house air with a normal or reduced content of oxygen and/or a reaction substance generated by a reaction between the air and the target.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTIONS OF THE DRAWINGS

The present disclosure is further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

Figure 13:
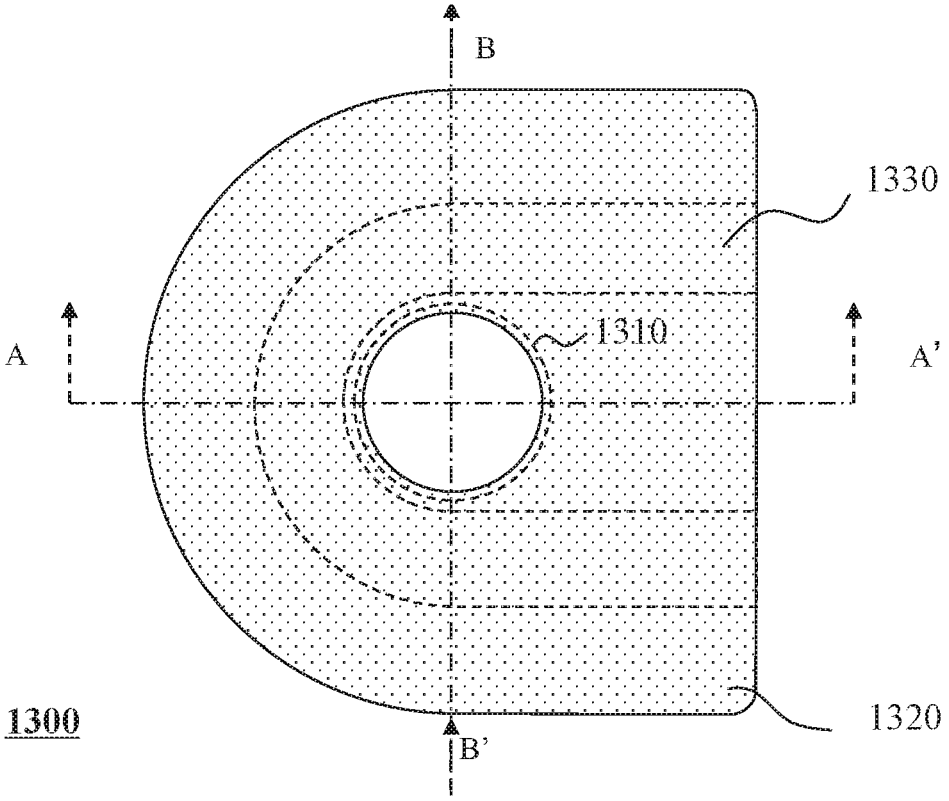
Figure 14:
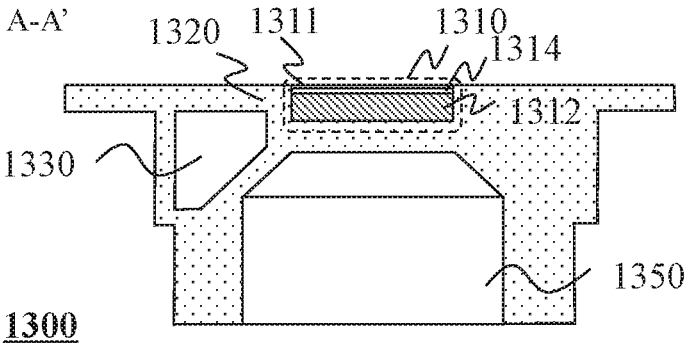
Figure 15:
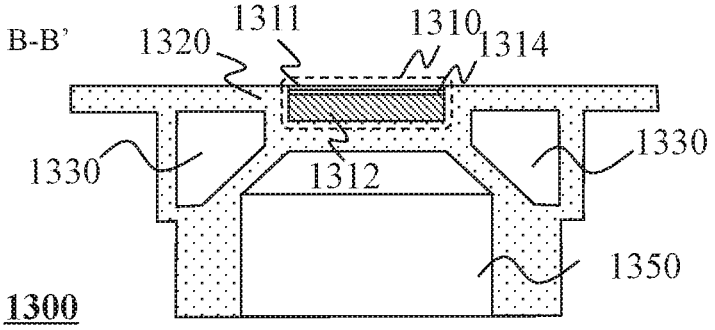
Figure 16:
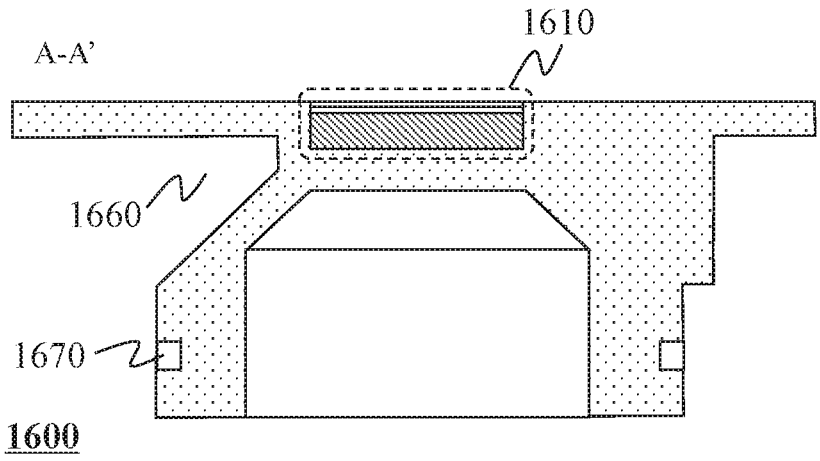
Figure 17:
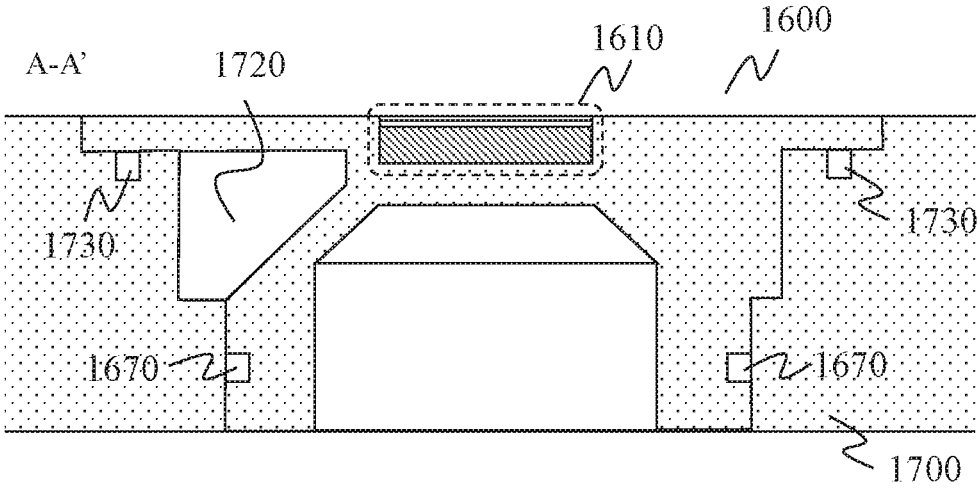
Figure 18:
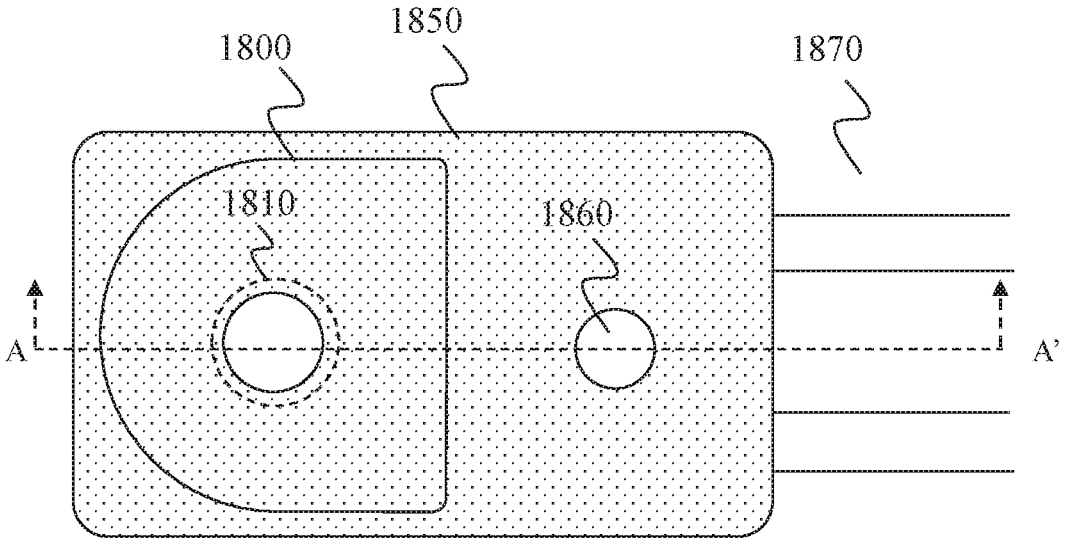
Figure 19:
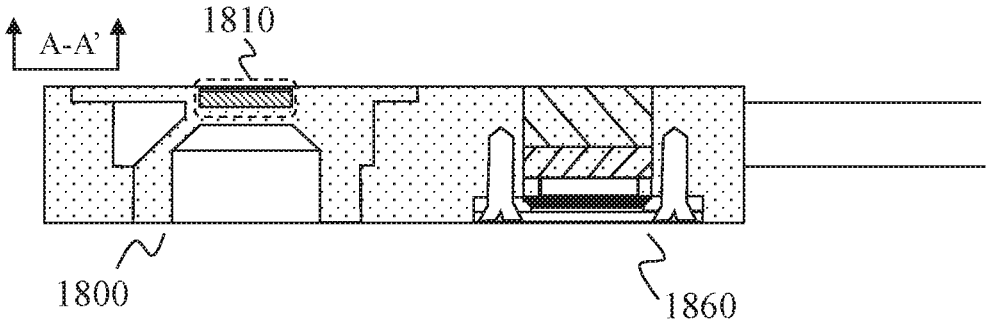
Figure 20:
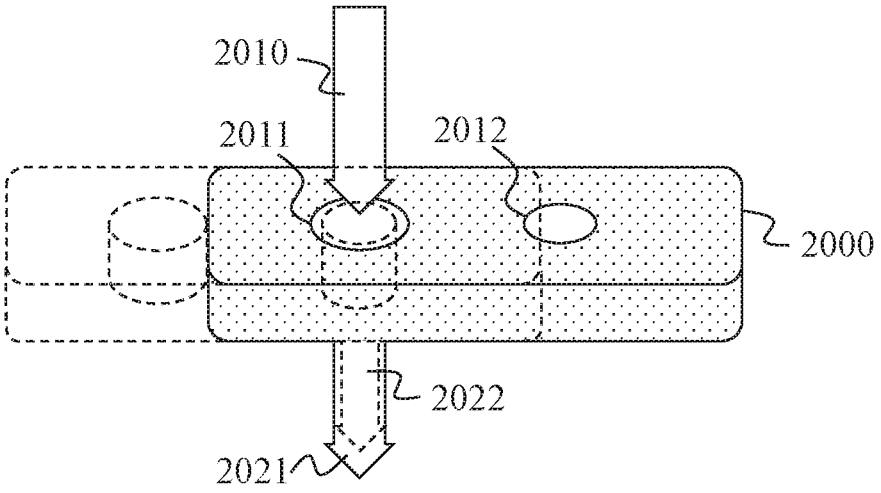
Figure 21:
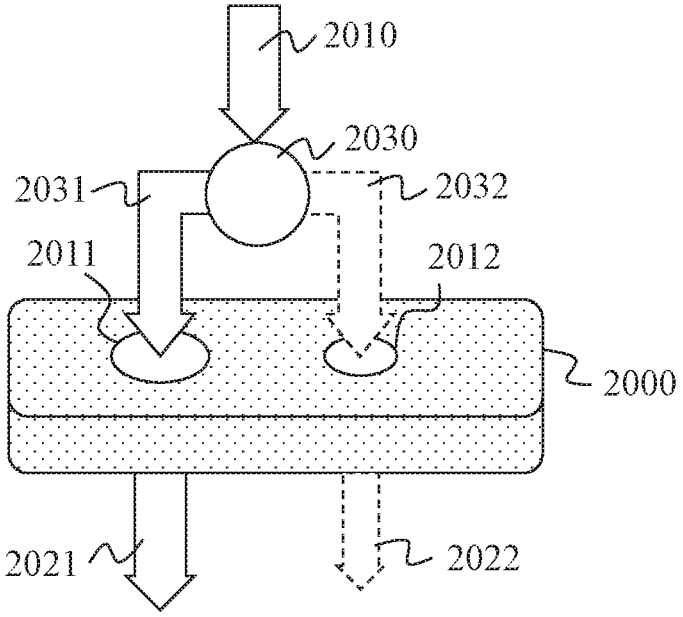
Figure 22:
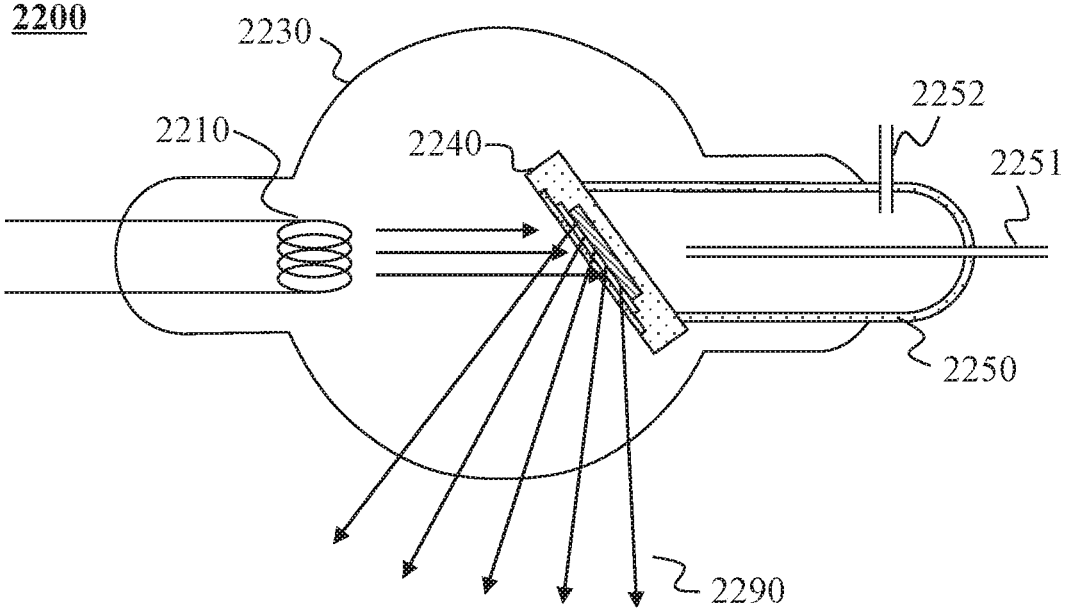
Figure 23:
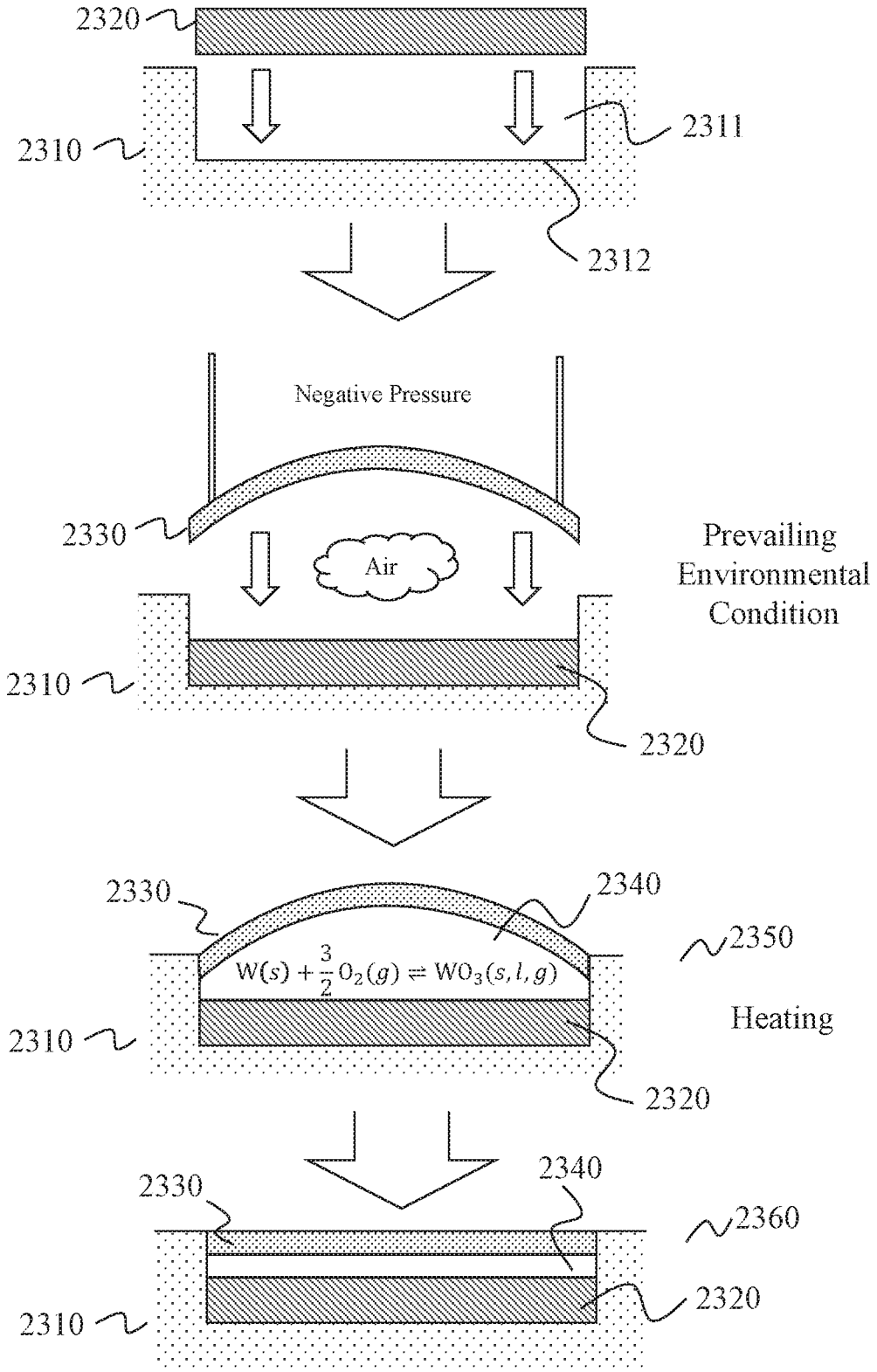
Figure 24:
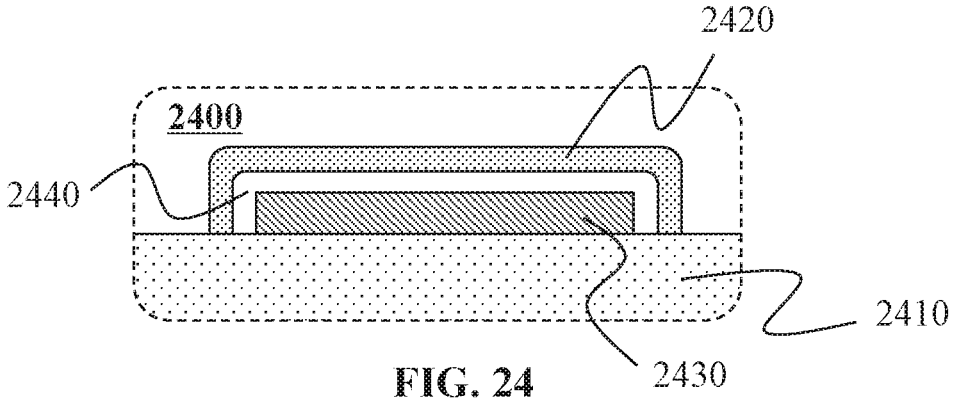
Figure 25:
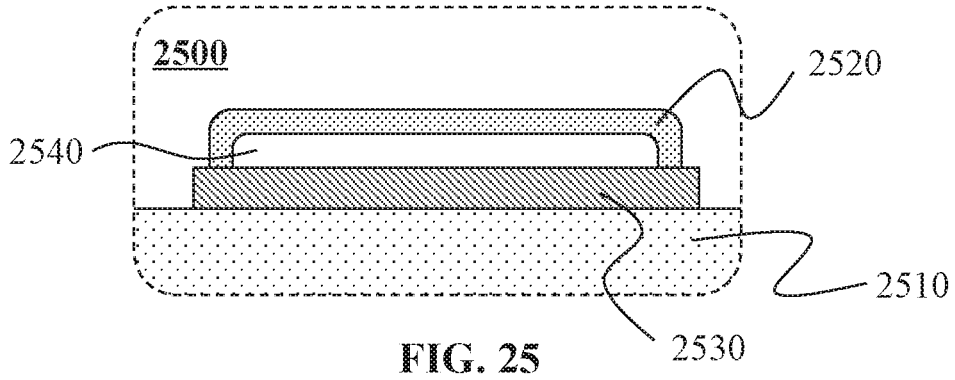

FIGS. 13, 14, and 15 are schematic diagrams illustrating an exemplary target assembly according to some embodiments of the present disclosure;

FIGS. 16 and 17 are schematic diagrams illustrating an exemplary target assembly according to some embodiments of the present disclosure;

FIGS. 18 and 19 are schematic diagrams illustrating an exemplary target assembly mounted on a carrier according to some embodiments of the present disclosure;

FIGS. 20 and 21 are schematic diagrams illustrating exemplary techniques for switching between a plurality of radiation generation mechanisms;

FIG. 22 is a schematic diagram illustrating an exemplary radiation generator including a target assembly according to some embodiments of the present disclosure;

FIG. 23 is a schematic diagram illustrating an exemplary process for assembling a target assembly according to some embodiments of the present disclosure; and FIGS. 24 and 25 are schematic diagrams illustrating exemplary core parts of target assemblies according to some embodiments of the present disclosure

DETAILED DESCRIPTION

The present disclosure is directed to a target assembly, a radiation apparatus incorporating the same, and a method for manufacturing the same. In the target assembly, a target may be hermetically sealed within a chamber filled with air or air with a reduced content of oxygen.

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that the term "system," "unit," "module," and/or "block" used herein are one method to distinguish different components, elements, parts, section or assembly of different level in ascending order. However, the terms may be displaced by another expression if they achieve the same purpose.

All technical and scientific terms used herein have the same meaning as commonly understood by one of ordinary skill in the art unless defined otherwise. Various relative terms are used in the description and claims such as "on," "upper," "above," "over," "under," "top," "bottom," "higher," and "lower," etc. These relative terms are defined with respect to the conventional plane or surface being on the top surface of the structure, regardless of the orientation of the structure, and do not necessarily represent an orientation used during manufacture or use. The following detailed description is, therefore, not to be taken in a limiting sense.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure.

Figure 1:
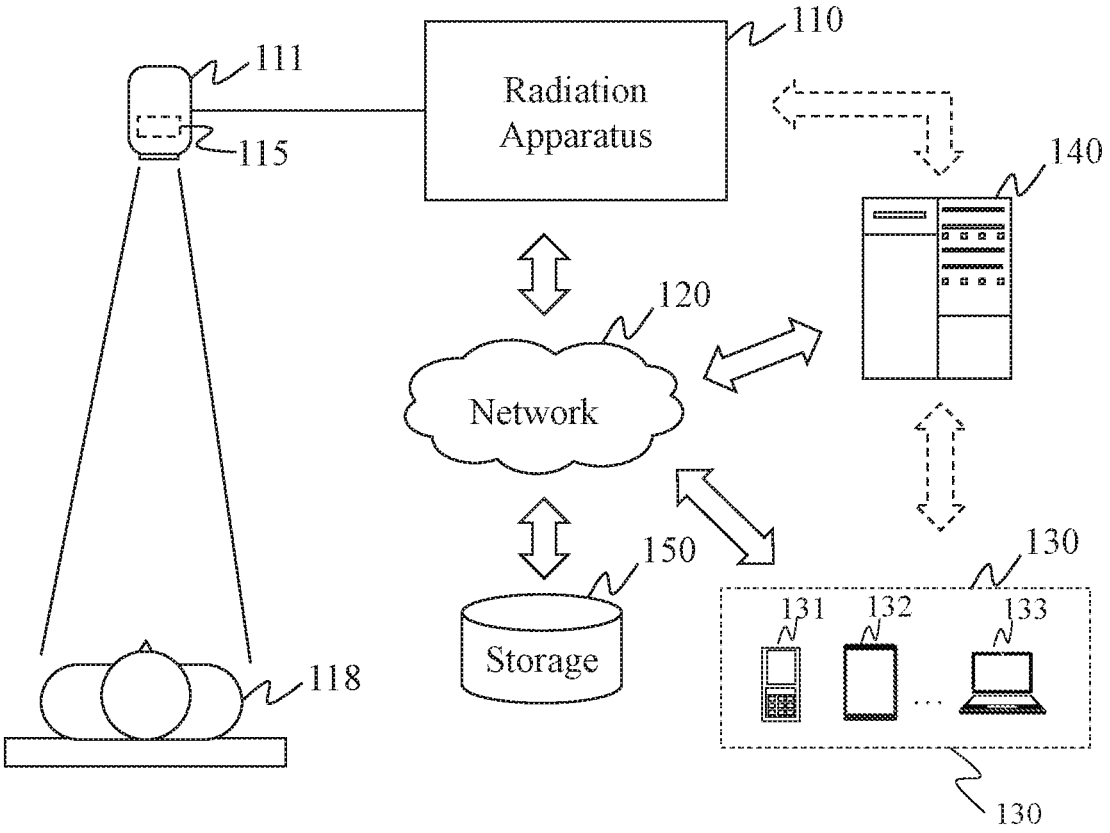
FIG. 1 is a schematic diagram illustrating an exemplary X-ray generation system according to some embodiments of the present disclosure.

FIG. 1 is a schematic diagram illustrating an exemplary X-ray generation system according to some embodiments of the present disclosure. As shown, the radiation system 100 may include a radiation apparatus 110, a network 120, one or more terminals 130, a processing engine 140, and a storage device 150.

Figure 2:
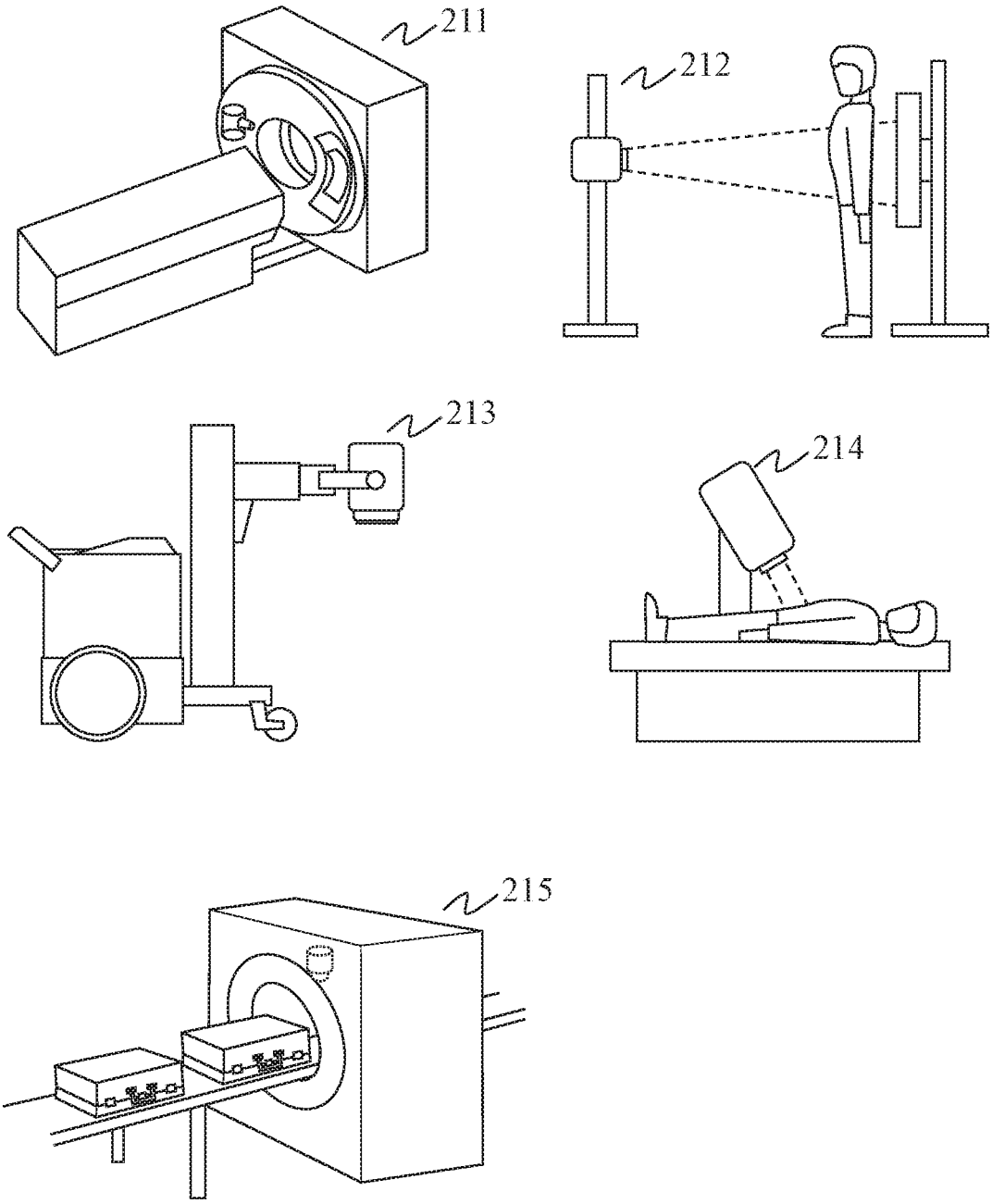
FIG. 2 is a schematic diagram illustrating exemplary radiation apparatus according to some embodiments of the present disclosure.

The radiation apparatus 110 may be configured to perform an inspection to a region or volume inside a subject 118 (imaging), or deliver a radiation treatment to a region or volume of the subject 118 (treatment). The radiation apparatus 110 may perform the imaging or radiation treatment by emitting radiation with a predetermined type and dose. The radiation may penetrate into a target region or volume of the subject 118. The radiation apparatus 110 may further include a detector (e.g., flat panel detector/electronic portal imaging device) for receiving the radiation penetrating through the subject 118 and for generating imaging data therefrom. The radiation apparatus 110 may be a device for medical imaging, radiation therapy, non-destructive testing (e.g., for buildings, machines, materials), security inspection, or the like, or a combination thereof. Exemplary application fields of the radiation apparatus 110 are illustrated in FIG. 2.

Figure 3:
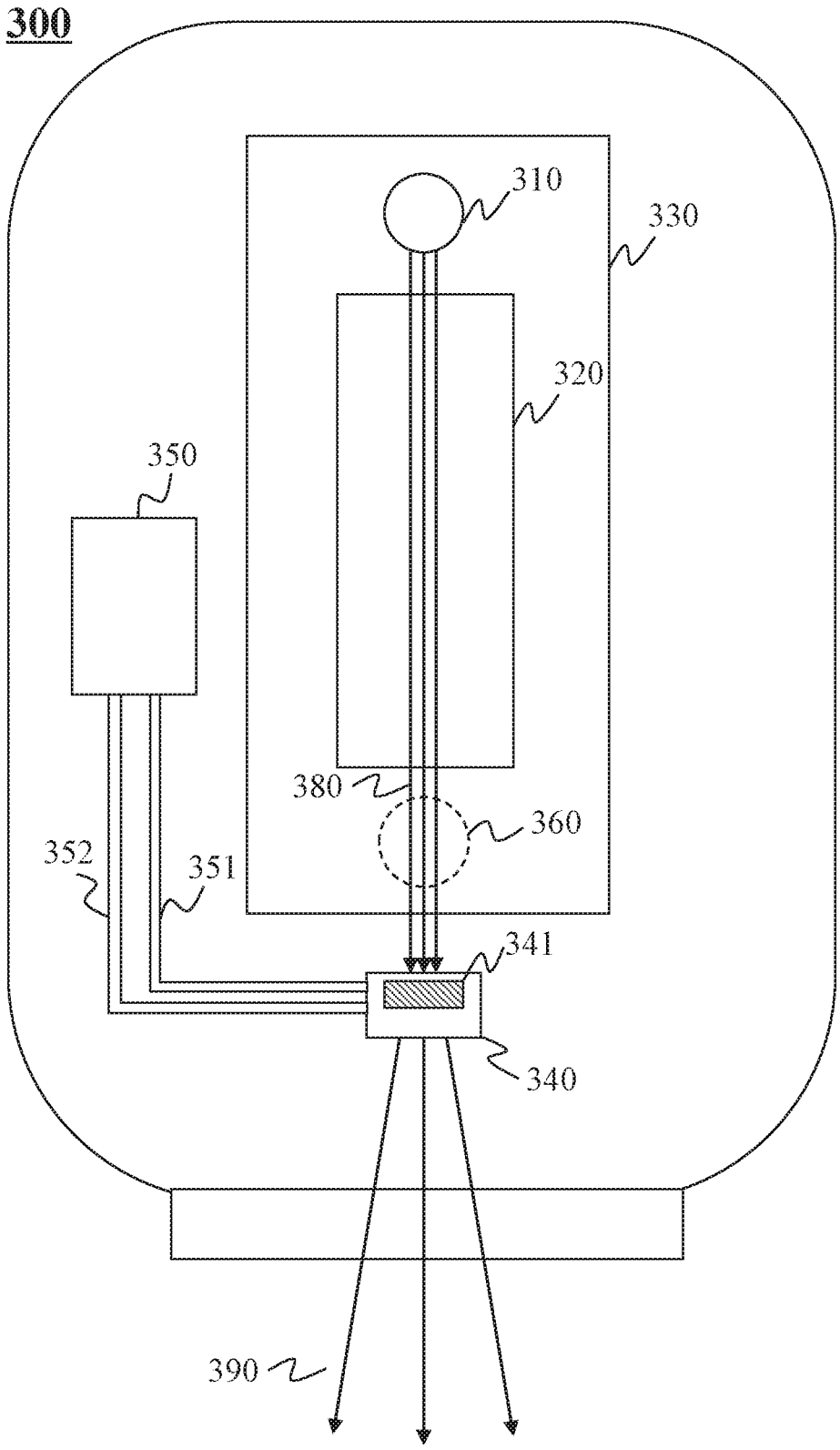
FIG. 3 is a schematic diagram illustrating an exemplary radiation generator including a target assembly according to some embodiments of the present disclosure.

The radiation apparatus 110 may include a radiation generator 111. The radiation generator 111 may generate radiation of one or more types, each of which may have a certain frequency (or frequency range) and/or intensity, such as X-ray, high-energy X-ray, etc. The radiation generator 111 may receive control signals from a built-in controller of the radiation apparatus 110 and/or the console 114, and perform a related function in response to the control signal, such as the initiation or termination of radiation generation, a change of radiation type (frequency and/or intensity), a change of radiation dose, or the like, or a combination thereof. Exemplary radiation generators are illustrated in FIGS. 3 and 20.

Figure 8:
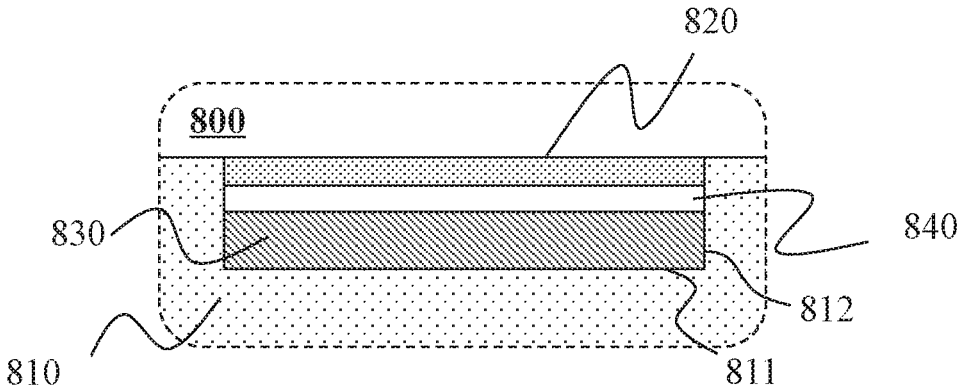
FIG. 8 is a schematic diagram illustrating an exemplary core part of a target assembly according to some embodiments of the present disclosure.

The radiation generator 111 may include a target assembly 115. The target assembly 115 may include a target, a substrate, and a window (e.g., as shown in FIG. 8). The target may generate radiation when impinged by a beam of charged particles (e.g., an electron beam). The beam may be generated by a beam generator (not shown in FIG. 1) of the radiation generator 111. The substrate may provide mechanical support for the target. The window may be at least partially permeable to the beam. The window and the substrate may form at least part of a hermetically sealed chamber in which at least a portion of the target is positioned. For example, the window and the substrate may form the whole hermetically sealed chamber. As another example, the window, the substrate, and one or more additional components may form the hermetically sealed chamber. The chamber may be filled with gas. In some embodiments, the gas is air with a normal or reduced content of oxygen.

In some embodiments, the radiation apparatus 110 may include a plurality of radiation generators 111. For example, the radiation apparatus 110 may include a first radiation generator 111 for imaging and a second radiation generator 111 for radiation treatment.

In some embodiments, the radiation apparatus may include only one radiation generator 111. The only radiation generator 111 may generate radiations of only one type, such as X-ray. Alternatively, the only radiation generator 111 may generate radiations of multiple energy levels, such as X-ray and high energy X-ray.

The radiation apparatus 110 may further include other components, such as a power unit, a cooling unit, a connection interface, a communication interface. These components may facilitate the operation of the radiation generator 111.

The network 120 may include any suitable network that can facilitate the exchange of information and/or data for the radiation system 100. In some embodiments, one or more components of the radiation system 100 (e.g., the radiation apparatus 110, the terminal 130, the processing engine 140, the storage device 150) may communicate information and/or data with one or more other components of the radiation system 100 via the network 120. For example, the processing engine 140 may send the control signals to the radiation apparatus 110 through the network 120. As another example, the processing engine 140 may obtain information or data from the radiation apparatus 110 via the network 120. Merely by way of example, the network 120 may include a cable network, a wireline network, a fiber-optic network, a telecommunications network, an intranet, a wireless local area network (WLAN), a metropolitan area network (MAN), a public telephone switched network (PSTN), a Bluetooth™ network, a ZigBee™ network, a near field communication (NFC) network, or the like, or any combination thereof. In some embodiments, the network 120 may include one or more network access points. For example, the network 120 may include wired and/or wireless network access points such as base stations and/or internet exchange points through which one or more components of the radiation system 100 may be connected to the network 120 to exchange data and/or information.

The terminal(s) 130 may be used by a user to control the processing engine 140 and present information from the processing engine 140 to the user. The terminal 130 may include a mobile apparatus 131, a tablet computer 132, a laptop computer 133, or the like, or any combination thereof. In some embodiments, the mobile apparatus 131 may include, a wearable device, a mobile device, a virtual reality device, an augmented reality device, or the like, or any combination thereof. In some embodiments, the wearable device may include a bracelet, footgear, eyeglasses, a helmet, a watch, clothing, a backpack, a smart accessory, or the like, or any combination thereof. In some embodiments, the mobile device may include a mobile phone, a personal digital assistant (PDA), a laptop, a tablet computer, a desktop, or the like, or any combination thereof. In some embodiments, the virtual reality device and/or the augmented reality device may include a virtual reality helmet, virtual reality glasses, a virtual reality patch, an augmented reality helmet, augmented reality glasses, an augmented reality patch, or the like, or any combination thereof. For example, the virtual reality device and/or the augmented reality device may include a Google Glass™, an Oculus Rift™, a Hololens™, a Gear VR™, etc. In some embodiments, the terminal(s) 130 may be part of or communicate with the processing engine 140, such as a key-board, a mouse, a joystick, a microphone, a loudspeaker, a display, a touch screen, or the like, or a combination thereof.

The processing engine 140 may process data and/or information obtained from the radiation apparatus 110, the terminal 130, and/or the storage device 150. The processing engine 140 may also send control signals to the radiation apparatus 110 to perform an imaging and/or a radiation treatment. For example, the processing engine 140 may be configured to set parameters of the radiation emitted, such as its type, frequency, intensity, dose, start time, end time, emission duration, or the like, or a combination thereof.

In some embodiments, the radiation apparatus 110 may have a function of imaging. Alternatively or additionally, the radiation apparatus 110 may have a function of treatment. The processing engine 140 may provide radiation parameters to the radiation apparatus 110 so that the radiation apparatus 110 may perform an imaging function and/or a treatment function accordingly. The processing engine 140 may acquire imaging data from the detector of the radiation apparatus 110 and generate an image (e.g., X-ray image, CT image) of the subject 118 based on received imaging data from the radiation apparatus 110.

In some embodiments, the radiation apparatus 110 may have both a function of radiation treatment and a function of imaging. For example, the processing engine 140 may be configured to obtain images of the subject 118 before, during, or after a radiation treatment. The images may be used (e.g., by an intelligent module of the processing engine 140, or by a user of the radiation system 110 such as a doctor or a technician) for diagnosis, verification and recordation of a patient position, and verification and recordation of an internal patient portal to which treatment radiation is delivered.

The processing engine 140 may be a computer, a user console, a single server, or a server group (centralized or distributed), etc. The processing engine 140 may be local or remote. For example, the processing engine 140 may access information and/or data stored in or acquired by at least one of the radiation apparatus 110, the terminal 130, and/or the storage device 150 via the network 120. As another example, the processing engine 140 may be directly connected to at least one of the radiation apparatus 110, the terminal 130 and/or the storage device 150 to access stored or acquired information and/or data. In some embodiments, the processing engine 140 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

The storage device 150 may store data, instructions, and/or any other information. In some embodiments, the storage device 150 may store data obtained from the terminal 130 and/or the processing engine 140. In some embodiments, the storage device 150 may store data and/or instructions that the processing engine 140 may execute or use to perform exemplary methods described in the present disclosure. In some embodiments, the storage device 150 may include a mass storage device, a removable storage device, a volatile read-and-write memory, a read-only memory (ROM), or the like, or any combination thereof. In some embodiments, the storage device 150 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 150 may be connected to the network 120 to communicate with one or more other components in the radiation system 100 (e.g., the processing engine 140, the terminal 130). One or more components of the radiation system 100 may access the data or instructions stored in the storage device 150 via the network 120. In some embodiments, the storage device 150 may be directly connected to or communicate with one or more other components of the radiation system 100 (e.g., the processing engine 140, the terminal 130). In some embodiments, the storage device 150 may be part of the processing engine 140.

It should be noted that the above descriptions about radiation system 100 are only for illustration purposes, and are not intended to limit the scope of the present disclosure. It is understandable that, after learning the major concept and the mechanism of the present disclosure, a person of ordinary skill in the art may alter radiation system 100 in an uncreative manner. The alteration may include combining and/or splitting components, adding or removing optional components, etc. All such modifications are within the protection scope of the present disclosure.

FIG. 2 is a schematic diagram illustrating exemplary radiation apparatus according to some embodiments of the present disclosure. The radiation apparatus 110 may be a medical imaging device, such as a computed tomography (CT) scanner 211, a digital radiography (DR) scanner 212, a mobile DR 213, a radiation treatment device 214, an inspection device 215 for security inspection or NDT. A radiation apparatus may include a radiation generator, like the radiation generator 111 illustrated in FIG. 1, in the configuration of a tube (e.g., X-ray tube) or a linear accelerator. For demonstration purposes, the present disclosure is described with reference to a linear accelerator. However, it is understood that the principle of the present disclosure may be applied to a tube configuration as well.

FIG. 3 is a schematic diagram illustrating an exemplary radiation generator including a target assembly according to some embodiments of the present disclosure. The radiation generator 300 is an exemplary embodiment of the radiation generator 111. The radiation generator 300 may be configured to generate radiation (e.g., radiation 390). The radiation generator 300 may be a linear accelerator as illustrated in FIG. 3. An exemplary radiation generator in the tube configuration is illustrated in FIG. 22. The radiation generator 300 may include an electron source 310, a waveguide 320, a target assembly 340, and a cooling unit 350. The electron source 310 and the waveguide 320 may be positioned inside a vacuum envelope 330. The target assembly 340 may be positioned inside or outside of the vacuum envelope 330. The target assembly 340 may include a target 341. The radiation generator 300 may further include additional components that may facilitate the radiation generation (e.g., a power unit, an interface unit, a dosimeter). In some embodiments, optionally, the radiation generator 300 may further include a beam director 360.

The electron source 310 may emit electrons, which may be received by the waveguide 320 to form an electron beam. The electron source 310 may be an electron gun, which may include a heater, a cathode (thermionic or another type), a control grid (or diode gun), a focus electrode, an anode, and other elements. The electron source 310 may also be a cathode such as a tungsten filament.

The waveguide 320 may accelerate the received electrons to form an electron beam. After the acceleration, the formed electron beam may exit from the waveguide 320 and propagate to the target assembly 340.

In some embodiments, the waveguide 320 may generate oscillated electric fields or pulsed microwave energies to accelerate the received electrons. The waveguide 320 may modulate the electrons to a target energy level (e.g., a mega voltage level).

In some embodiments, the wave guide 320 may be omitted (e.g., when the radiation generator 300 is a tube). The acceleration of the electrons may be implemented by applying a positive voltage to the target assembly 340 or the target 341 (as an anode) with respect to the electron source 310 (as a cathode). The electrons may then be accelerated towards the target assembly 340 by electrostatic force to form an electron beam.

The vacuum envelope 330 may provide a substantially vacuum environment for the electron source 310, the wave guide 320, as well as any other components of the radiation generator 300. The vacuum envelope 330 may be hermetically sealed. In some embodiments, the radiation generator 300 may further include a vacuum pump (not shown in FIG. 3) to maintain any necessary vacuum within the vacuum envelope 330. Alternatively, the vacuum envelope 330 may be made vacuum and completely sealed during the production of the radiation generator 300 and does not need a vacuum provider (e.g., a vacuum pump). In some embodiments, the vacuum envelope 330 may house the radiation generator 300 (e.g., as a tube) and may be at least partially permeable to the radiation generated.

The target assembly 340 may receive the electron beam and emit the radiation (e.g., X-ray) having an energy spectrum suitable for imaging, radiation treatment, security inspection, etc. The target assembly 340 may be an example of the target assembly 115 and any related description of the target assembly 115 may be incorporated into the description of the target assembly 340. The target assembly 340 may include a target 341 and other components to facilitate the radiation generation.

The target 341 may include a hi-Z (i.e., high atomic weight) material such as gold, silver, tungsten, iridium, platinum, or another suitable material. When impinged by the electron beam, the target 341 may generate radiation (e.g., through a bremsstrahlung conversion) of a certain frequency and/or intensity. The target 341 may be a metal, an alloy, a film of one material that is capable of generating the radiation disposed on another material (e.g., used for anode), etc. The target 341 may be in the form of a disk or plate. In some embodiments, the radiation generated by the target 341 may be X-rays, and the target 341 may generate X-ray through the bremsstrahlung conversion. In such applications, the target 341 may be referred to as an "X-ray target", an "electron target", a "photon target," or a bremsstrahlung converter.

Figure 4:
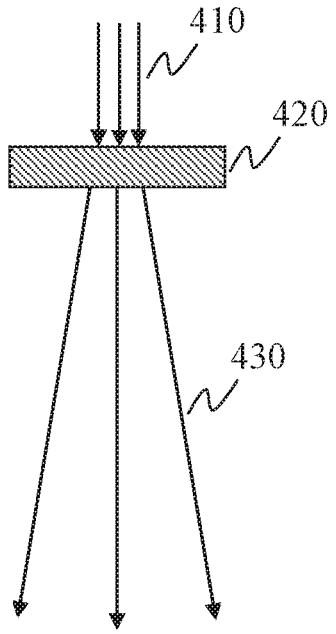
FIGS. 4 and 5 are schematic diagrams illustrating exemplary shaping manners of radiation generated by a target according to some embodiments of the present disclosure.
Figure 5:
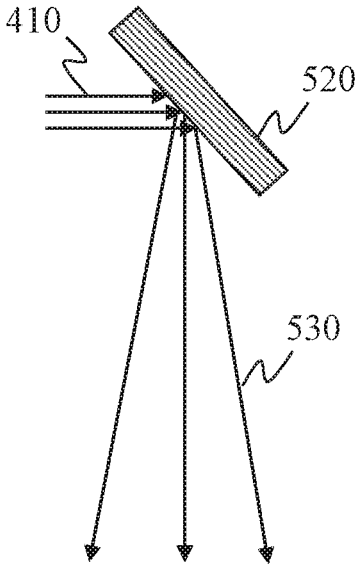

The generated radiation may be shaped and directed by a shaping component of the radiation generator 300 (not shown in FIG. 3). After being shaped by the shaping component, the radiation may be in the direction of the incident electron beam (e.g., as shown in FIG. 4) or not (e.g., as shown in FIG. 5). The shaping component may be a stand-alone structure (e.g., a collimator) or be integrated into the target assembly 340.

Figure 11:
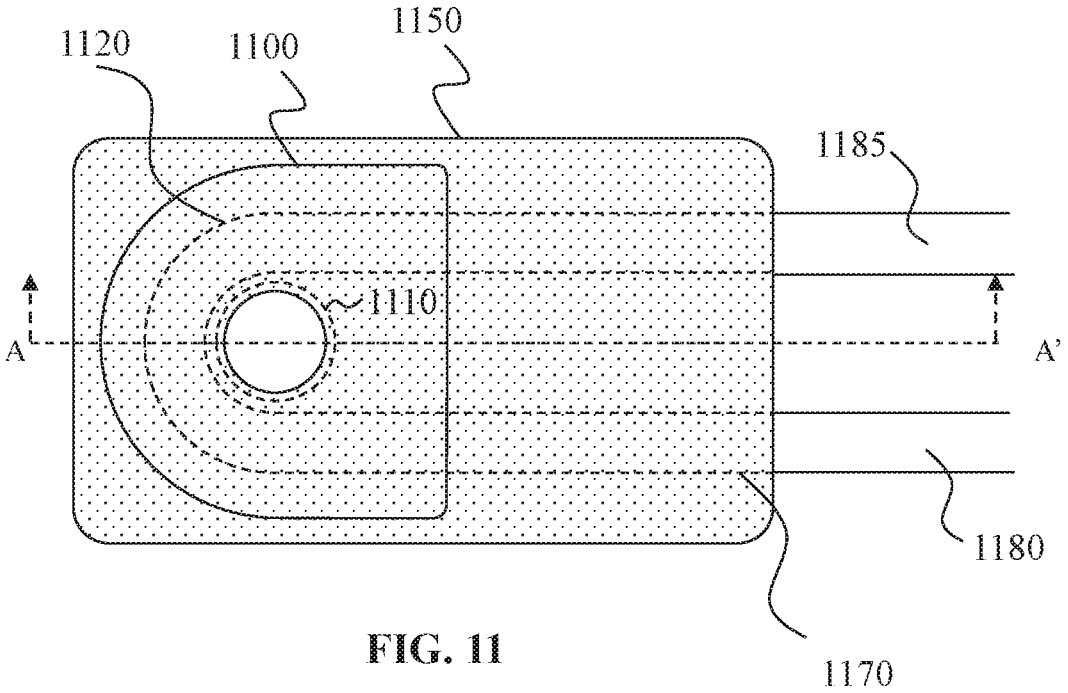
FIGS. 11 and 12 are schematic diagrams illustrating an exemplary target assembly mounted on a carrier according to some embodiments of the present disclosure.
Figure 12:
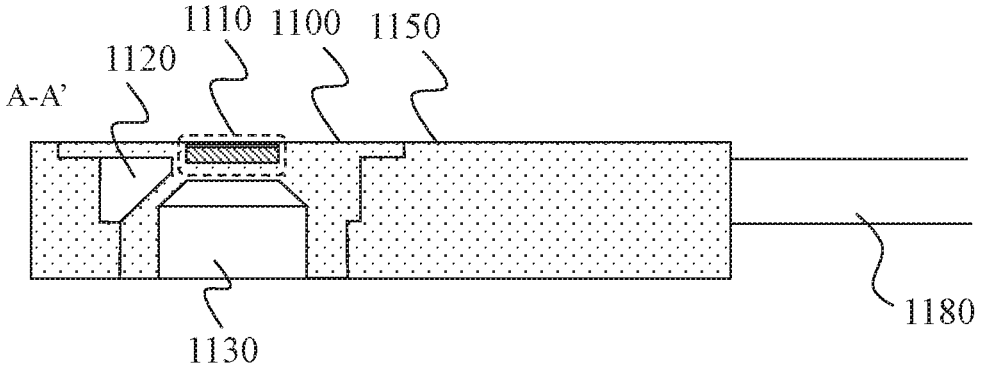

In some embodiments, the target assembly 340 may be mounted on a carrier (e.g., as shown in FIGS. 11 and 12) for supporting the target assembly 340 in the radiation generator 300. The target assembly 340 may further include a connection structure for mounting the target assembly on the carrier. In some embodiments, the target assembly 340 may be detachably mounted on the carrier through the connection structure so that the target assembly 340 may be detached for repair and/or replacement. The detachably mounting mechanism may also allow a replacement of the target assembly 340 with another radiation generation module capable of generating radiation (e.g., of another type and/or intensity).

In some embodiments, the carrier may further hold a second radiation module (e.g., as shown in FIGS. 13 and 14). The second radiation module may generate second radiation when impinged by an electron beam. The radiation generated by the target assembly 340 (or referred to as first radiation) and the second radiation may be different in frequency and/or intensity. Various techniques may be adopted in the radiation generator 300 for allowing an electron beam to reach either one of the target assembly 340 and the second radiation module. Exemplary techniques are illustrated in FIGS. 20 and 21.

The second radiation module may be a part of the carrier. Alternatively, the second radiation module may be mounted (detachably or non-detachably) on the carrier via, e.g., a connection structure. The second radiation module may be another target assembly with a structure the same as or similar to that of the target assembly 340. Alternatively, the second radiation may have a substantially different structure compared to the target assembly 340.

Figure 6:
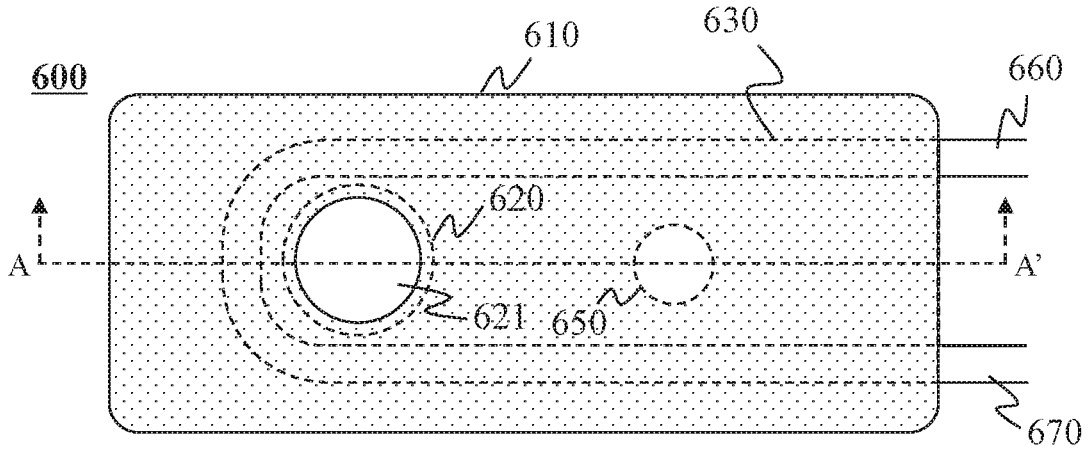
FIGS. 6 and 7 are schematic diagrams illustrating an exemplary target assembly according to some embodiments of the present disclosure.
Figure 7:
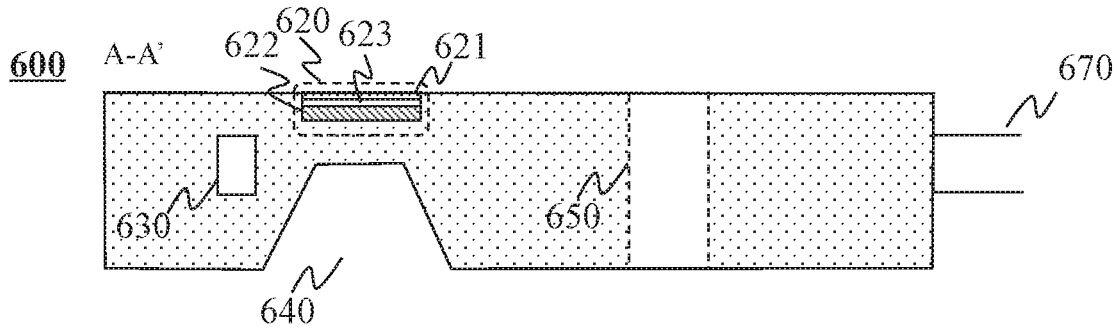

In some embodiments, the target assembly 340 and the aforementioned carrier may be integrated together into a single structure, which may also be referred to as a target assembly (e.g., as shown in FIGS. 6 and 7). In the present disclosure, any mechanical device, component, or module having a substrate as illustrated in FIG. 8 or a variation thereof will be referred to as a target assembly within the scope of the present disclosure.

In some embodiments, the target assembly 340 may include a plurality of targets 341 for generating a plurality of radiations with various frequency and/or intensity. The plurality of targets may be different in size, shape, and/or material. Various techniques may be adopted in the radiation generator 300 for allowing an electron beam to reach any one or more of the plurality of targets. Techniques illustrated in FIGS. 20 and 21 may also be adopted herein.

The cooling unit 350 may deliver a cooling medium (e.g., water, air, oil) to the target assembly 340. The used cooling medium may be cooled and reused, or emitted to the environment (e.g., air). The cooling unit 350 may be inside or outside of the housing of radiation generator. For example, the cooling unit 350 may be positioned in the radiation apparatus 110. The cooling unit 350 may deliver the cooling medium and receive the used cooling medium through conduits 351 and 352. The conduits 351 and 352 may connect to a conduit or tube (not shown in FIG. 3) for cooling the target assembly 340. Optionally, the cooling unit 350 may be used to cool other components of the radiation generator 300, such as the electron source 310, the waveguide 320, etc.

In some embodiments, the radiation generator 300 may include the beam director 360 configured to change the direction of the electron beam. In some embodiments, the target 341 may be positioned out of the pathway of the electron beam when the electron beam exits from the waveguide 320. The beam director 360 may direct the beam direction so that the electron beam may reach the target 341. Alternatively or additionally, the beam director 360 may be configured to change the propagation path of the electron beam between a first path or a second path, along each of which a target or a radiation generation module may be reached (e.g., as shown in FIG. 21). The beam director 360 may include a magnet and/or an electrostatic lens for redirecting the electron beam.

It should be noted that the above descriptions about the radiation generator 300 are only for illustration purposes, and not intended to limit the scope of the present disclosure. It should be understood that, after learning the major concept and the mechanism of the present disclosure, a person of ordinary skill in the art may alter radiation generator 300 in an uncreative manner. The alteration may include combining and/or splitting components, adding or removing optional components, etc. All such modifications are within the protection scope of the present disclosure.

FIGS. 4 and 5 are schematic diagrams illustrating exemplary shaping manners of radiation generated by a target according to some embodiments of the present disclosure. The radiation generated by the target (e.g., target 420) when impinged by a beam (e.g., beam 410 and, 420) may include radiation rays propagating in random directions. Through a shaping processes performed by a shaping component of the radiation generator 300 (not shown in FIGS. 4 and 5) on the radiation, the direction of the radiation rays may be redirected so that the shape (e.g., straight-line like, fan like, column-like, cone-like) and the direction of the radiation may be decided. The shape and direction of the radiation may be in accordance with the configuration of the shaping component. As illustrated in FIG. 4, after the shaping, the direction of radiation 430 generated by the target 420 may be substantially in the incident direction of the electron beam 410. As illustrated in FIG. 5, after the shaping, the direction of radiation 530 generated by target 520 may be in a direction different from the incident direction of the electron beam 520. For demonstration purposes, the present disclosure is described with reference to the shaping manner illustrated in FIG. 4. However, it is understood that the principle of the present disclosure may be applied to the shaping manner illustrated in FIG. 5.

FIGS. 6 and 7 are schematic diagrams illustrating an exemplary target assembly according to some embodiments of the present disclosure. FIG. 6 illustrates a top view of a target assembly 600, and FIG. 7 illustrates a sectional view of a section A-A' of the target assembly 600. The target assembly 600 provides an exemplary embodiment of the target assembly 340. The target assembly 600 may include a substrate 610, a window 621, and a target 622. Some portions of the substrate 610 may form a conduit 630 (tube-like) and a recess 640 (optional). The target 622 may be the same as or similar to the target 341 and may generate radiation when impinged by a beam (e.g., an electron beam emitted by the electron source 310). Other components that may facilitate the radiation generation process may also be included in the target assembly 600.

The substrate 610 may provide mechanical support for the target 622 and other components of the target assembly 600. The window 621 may be at least partially permeable to the beam. The window 621 and the substrate 610 may form at least part a hermetically sealed chamber in which at least a portion of the target 422 is positioned. The chamber may include a space 623 being filled with a gas. In some embodiments, the gas may be air with a normal or reduced content of oxygen.

The substrate 610, the window 621, and the target 622 may form a core part 620 of the target assembly 600. More descriptions of the core part 620 may be found elsewhere in the present disclosure. See, e.g., FIG. 8 and the description thereof. The target assembly 600 may be an integral structure (without any detachable component) or be a multi-component structure (e.g., including one or more detachable components).

The conduit 630 may hold a cooling medium (e.g., water, air, oil). The cooling medium may come from a cooling unit (e.g., cooling unit 350) and flow through the conduit 630. The conduit 630 may have an inlet 660 and an outlet 670 for allowing the cooling media to flow in and flow out. The substrate 610 may facilitate the transfer of the heat generated by the target 622 during the radiation generation to the cooling medium flowing in the conduit 630. The conduit 630 may be of any proper shape or size that may facilitate the heat transfer.

The recess 640 (optional) may permit a transmission of the radiation generated by the target 622 when the radiation is generated in a manner as illustrated in FIG. 4. The recess 640 may be conical or of another shape the areas of whose cross-sections increase along the axis of the shape from the end near the target 622 toward the other end further away from the target 622. The recess 640 may be open to the ambient or be hermetically sealed. For example, the recess 640 may be sealed with a second window (not shown in FIG. 7) that is at least partially permeable to the radiation. In some embodiments, the recess 640 may hold components that may shape and/or direct the generated radiation.

Optionally, the target assembly 600 may further include a second radiation module 650 configured to generate second radiation when impinged by the beam (e.g., an electron beam emitted by the electron source 310). The second radiation module 650 may generate radiation (or referred to as second radiation) in response to a second beam, such as an electron beam. The second beam striking the second radiation module 650 as used herein may be of a same type (e.g., an electron beam) as a first beam impinge the target assembly 600. The sources, fluxes, voltages, and/or powers of the first beam and the second beam may be the same or different. In some embodiments, both the first beam and the second beam may be generated by the electron source 310.

The substrate 610 may also transfer heat from the second radiation module 650 to the cooling medium flowing through the conduit 630 during the generation of the second radiation.

The second radiation may have a frequency and/or intensity different from the radiation (or referred to as first radiation) generated by the target 622. For example, both the first radiation and the second radiation may be X-rays with different intensities. In some embodiments, the second radiation module may also include a target (e.g., a second target, not shown in FIGS. 6 and 7) for generating the second radiation. The second target and the target 622 may be different in size and/or material.

In some embodiments, the second radiation module 650 may have a structure that is the same as or similar to the core part 620. For example, the second radiation module 650 may also include a hermetically sealed chamber that is at least partially formed by a window and the substrate 610, and a target (e.g., the aforementioned second target) positioned inside the chamber. The chamber may be filled with air with a normal or reduced content of oxygen. Alternatively, the chamber may be substantially vacuum or filled with a non-reactive gas.

In some embodiments, the second radiation module 650 may have a structure substantially different from the core part 620. For example, the second radiation module 650 may include a target (e.g., the aforementioned second target) exposed to the ambient air.

The substrate 610 may be a flat plate as shown in FIG. 6, but may also be curved or of any proper shape.

Exemplary techniques for switching between the core part 620 and the second radiation module 650 may be found elsewhere in the present disclosure. See, e.g., FIGS. 20 and 21 and the description thereof.

FIG. 8 is a schematic diagram illustrating an exemplary core part of a target assembly (e.g., target assembly 600 or another target assembly mentioned in the present disclosure) according to some embodiments of the present disclosure. FIGS. 9 10, 24, and 25 illustrate exemplary embodiments (or variants) of core part 800. FIGS. 8 to 10, 24, and 25 are only provided for demonstration purposes and not intended to be limiting.

Figure 9:
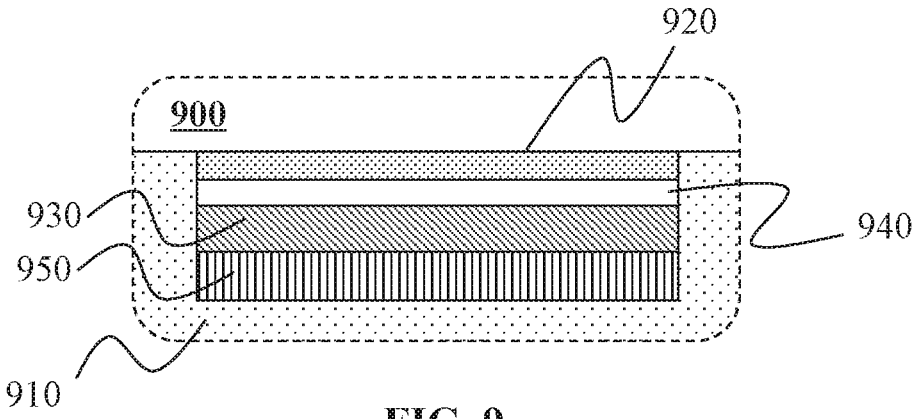
FIGS. 9 and 10 are schematic diagrams illustrating exemplary core parts of target assemblies according to some embodiments of the present disclosure.
Figure 10:
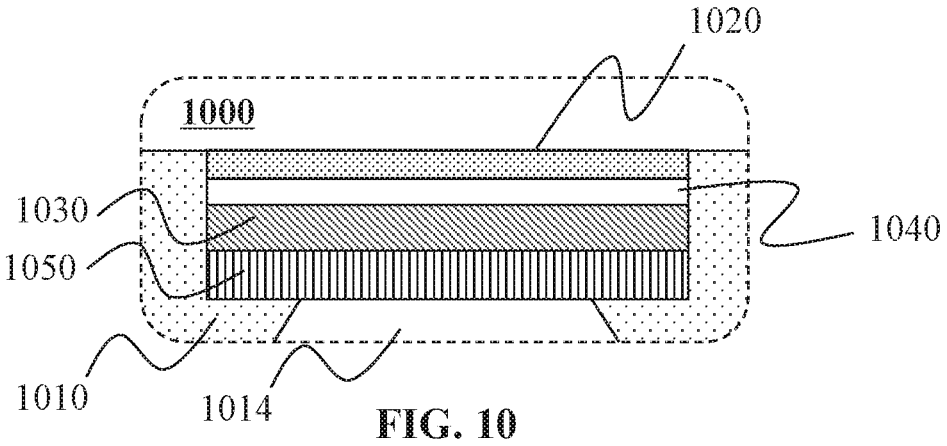

Core part 800 may include a portion of a substrate 810, a window 820 and a target 830. The substrate 810 and the window 820 may form at least part of a hermetically sealed chamber in which the target 830 is positioned. In some embodiments, the substrate 810 and the window 820 may form the whole hermetically sealed chamber. Alternatively, additional components may be needed to form the hermetically sealed chamber (e.g., as shown in FIG. 10). The hermetically sealed chamber may enclose the whole target 830 (e.g., as shown in FIGS. 8, 9, 10, and 24) or a portion of it (e.g., as shown in FIG. 25).

In some embodiments, the substrate 810 may include a cavity for positioning the target 830 and any other functional components inside the hermetically sealed chamber. The cavity may be a part of the hermetically sealed chamber (as shown in FIGS. 8, 9 and 10) and provides a space for holding the target 830. The cavity of the substrate 810 may have a size or shape suitable for accommodating the target 830 and the window 820. The cavity, the target 830, and the window 820 may be of any proper shape and/or size. The dimension and/or shape of the cavity, the target 830, and/or the window 820 may be the same or different. For example, the window 820 may have a larger diameter than the target 830. As another example, the target 830 may have a circular cross-section, while the window 820 may have a square cross-section. The target 830 may be in contact with a bottom 811 and/or a wall 812 of the cavity. Alternatively or additionally, the target 830 may be in contact with functional components (if any) in the hermetically sealed chamber (e.g., as shown in FIGS. 9 and 10). The functional components may facilitate radiation generation (e.g., a focusing component, a collimator, a filter).

It may be noted that the substrate 810 may be configured without a cavity. In some embodiments, the window 820 may have a proper shape (e.g., cup-shaped, domelike) for providing a space holding the target 830 and/or any other components inside the chamber. Exemplary embodiments are illustrated in connection with in FIGS. 24 and 25 for demonstration purposes.

In some embodiments, the substrate 810 may have a cavity and the window 820 may also be cup-shaped or domelike. The cavity and the cup-like window 820 together may provide a space large enough for holding the target 830. For example, the cavity may provide a space for holding a portion of the target, while the window 820 may provide another space for holding another portion of the target Inside the chamber there may be a space 840 filled with air having a normal or a reduced content of oxygen. The filled air may react with the target 830 to generate a reaction substance. The reaction substance may remain in the space 840. The reaction substance in the space 840 may be in at least one of the solid state, the liquid state, or the gaseous state, depending on, e.g., the temperature of the core part 2540 or the ambient temperature.

The target 830 may generate radiation when impinged by a beam. The target 830 may be the same as or similar to the target 341 as provided in connection with FIG. 3. The target 830 may take the form of a disk or plate and may also be referred to as a target disk or a target plate. In some embodiments, the target 830 may generate X-rays when impinged by an electron beam. The target 830 may be made of a material including, e.g., tungsten (or any other high-Z metal, such as gold and platinum) for generating X-ray when impinged by an electron beam. The target 830 may be made of pure tungsten, a tungsten alloy, or a disk or plate (e.g., made of another metal or alloy) having a tungsten film deposited thereon.

The substrate 810 may provide mechanical support and/or protection to the target 830 and one or more other components of the target assembly. The substrate 810 may be thermally conductive so that heat generated by the target 830 during radiation generation may be effectively transferred to a conduit holding a cooling medium (e.g., conduit 630) through the substrate 810. The location (e.g., the cavity) for positioning the target 820 on the substrate 810 may be set near the conduit to facilitate the heat transfer.

The substrate 810 may be made of a metal, e.g., copper, or an alloy thereof. The substrate may include one or more components made of a same material or different materials. The one or more components may be mounted together detachably (e.g., through a connection structure such as a bolt, a screw, a slot, a hole, etc.) or non-detachably (e.g., by welding).

The window 820 may be at least partially permeable to the beam (e.g., an electron beam) for generating radiation. The window 820 may be a simple plate or be integrated with a functional structure to perform a corresponding function. For example, the window 820 may also be at least partially permeable to the radiation generated by the target 830 and be shaped as a truncated cone for adjusting the focus of the generated radiation. See, for example, the exemplary radiation illustrated in FIGS. 4 and 5. In some embodiments, if the incident beam is an electron beam, the window 820 may be made of a material including beryllium, or the like, or an alloy thereof.

The core part 800 or a target assembly including the core part 800 (e.g., target assembly 340, target assembly 600, and any other target assembly described in the present disclosure) may be assembled in a process described in connection with FIG. 23. After the assembly and before the heating (e.g., in a conditioning operation of the manufacturing process, or in practical use) of the target assembly, the space 840 may be filled with the ambient air with a normal oxygen content. During the heating of the target assembly, the target 830 may be oxidized by the oxygen of the air inside the space 840. The sizes of the space 840 and target 830 may be properly designed so that the mass loss of the target 830 due to the oxidation may be negligible. Further mass loss of the target 830 may be prevented as the chamber for holding the target 830 is hermetically sealed and the oxygen supply in the space 840 may be limited. After the heating, the space 840 may be filled with air having a reduced content of oxygen. As the oxidation of the target 830 reaches an equilibrium after the heating or when the target assembly is in use, the space 840 may contain a certain amount of oxygen, depending on the operating condition.

For illustration purposes and not intended to be limiting, a target assembly including a target plate (e.g., the target 830) made of tungsten is described.

The oxidation of tungsten in air may occur predominantly via an equilibrium reaction, which may be expressed as Equation (1):

$$W(s)+3/2O_2(g) \rightleftharpoons WO_3(s,l,g), \quad (1)$$

where the letters in parentheses indicate the phases of the substance: s for solid, l for liquid, and g for gas.

The side product tungsten trioxide $WO_3$ may become volatile at over 1100 degrees Celsius, within a typical operating range of a high output x-ray device such as a linear accelerator.

If the reaction is performed in a hermetically sealed chamber such as the one in the core part 800, gaseous tungsten trioxide may remain in equilibrium between its solid and liquid phases. The corresponding equilibrium reaction may be expressed as Equation (2):

$$3WO_3(s,l) \rightleftharpoons (WO_3)_3(g). \quad (2)$$

If the target plate is not enclosed in a hermetically sealed chamber, the gaseous tungsten trioxide may escape via volatilization, and the target plate may lose mass over time.

According to the present disclosure, in order to maintain the target mass, and to limit the amount of oxidation, the target assembly may include a hermetically sealed chamber to enclose the target plate. With a properly designed chamber (or the space 840), it may be sufficient to position the target plate within the hermetically sealed chamber without evacuating air when the chamber is sealed, and without substituting the air in the chamber by a non-reactive gas such as helium. The chamber (or the space 840) may also prevent a damage to the target or the window caused by a thermal expansion of the target and/or the window (e.g., due to a thermomechanical shock) during the radiation generation.

For example, the target assembly may include a tungsten plate having a diameter of 5 mm. If this plate is sealed in an enclosure with a 1 mm space between the window and the target plate, the volume of air thus enclosed is $\pi\times0.5^2/4\times0.1=0.0196$ ml. At the standard temperature and pressure (STP), air contains 0.0094 moles of oxygen per liter. When the space is hermetically sealed, the air in the space contains $0.0196\times10^{-3}\times0.0094=1.85\times10^{-7}$ moles, or 0.185 micromoles of oxygen.

According to Equation (1), a complete oxidation reaction may consume 0.12 micromoles of tungsten. Tungsten has an atomic mass of 183.84 grams/mole, and therefore 22.1 micrograms of tungsten may react with the available oxygen. For a tungsten plate that is 0.6 mm in thickness, which has a mass of $\pi\times0.5^2/4\times0.06\times19.3=0.23$ g. The mass of tungsten oxidized thus constitutes less than 0.01% of the original mass of the target plate. The oxidation loss that occurs is of such a negligible magnitude that it does not substantially affect the efficiency of production or spectral quality of the output radiation.

As the sealing of the target plate is performed without evacuating air or substituting the air by a non-reactive gas, the process for manufacturing the target assembly may be simplified. The lifespan of the target assembly may also be prolonged by isolating the target from the ambient air to reduce or avoid mass loss.

FIGS. 9 and 10 are schematic diagrams illustrating exemplary core parts of target assemblies according to some embodiments of the present disclosure. The core part 900 may include a substrate 910, a window 920, a target 930, and a space 940. Additionally, the core part 900 may further include one or more functional plates 950.

The substrate 910, the window 920, the target 930, and the space 940 may be the same as or similar to the substrate 810, the window 820, the target 830, and the space 840, the descriptions of which are not repeated here. The functional plate 950 may also be positioned in a chamber formed by the window 920 and the substrate 910.

In some embodiments, the functional plate 950 may be positioned underneath the target 930. The functional plate 950 may be at least partially permeable to radiation generated by the target 930. For example, the functional plate 950 may be made of a material including stainless steel or any other suitable material. The functional plate 950 may facilitate the radiation generation. For example, for a beam source emitting an electron beam, the functional plate 950 may act as an anode for accelerating the electrons emitted by the beam source. As another example, the functional plate may be configured to condition the generated radiation by way of, e.g., filtering, shaping, direction adjustment, focus modulating, or the like, or a combination thereof. At least a portion of the heat generated by the target 930 may be transferred to the substrate 910 through the functional plate 950.

In some embodiments, the functional plate 950 may be positioned above the target 930. The functional plate 950 may be at least partially permeable to the incident beam for radiation generation. For example, the radiation may be generated in a manner illustrated in FIG. 5. The functional plate may be at least partially permeable to the generated radiation and configured to condition the generated radiation.

The core part 1000 may include a substrate 1010, a window 1020, a target 1030, a space 1040, and a functional plate 1050. The substrate 1010, the window 1020, the target 1030, and the space 1040 may be the same as or similar to the substrate 810, the window 820, the target 830, and the space 840, the descriptions of which are not repeated here. As illustrated in FIG. 10, a cavity of the substrate 1010 may penetrate through the substrate 1010 and connect with a recess 1014 (e.g., corresponding to recess 640) formed on the substrate 1020. Besides the aforementioned function of the functional plate 950, the functional plate 1050 may also be used to form the hermetically sealed chamber together with the window 1020 and the cavity of the substrate 1010. For example, the functional plate 1050 may serve as the bottom of the cavity and separate the target 1030 from the recess 1014 and the ambient environment. Alternatively, the functional plate 1050 may seal the recess 1014 from the bottom thereof and the recess 1014 may be included in the chamber formed by the window 1020, the substrate 1010, and the functional plate 1050.

FIGS. 11 and 12 are schematic diagrams illustrating an exemplary target assembly mounted on a carrier according to some embodiments of the present disclosure. FIG. 11 illustrates a top view of a target assembly 1100 mounted on a carrier 1150, and FIG. 12 illustrates a sectional view of the cross-section A-A' of the target assembly 1100 mounted on the carrier 1150. The target assembly 1100 and the carrier 1150 together provide an example of the target assembly 340 or the target assembly 600. The target assembly 1100 may include at least part of a passage 1120. Optionally, the target assembly 1100 may include a recess 1130 that is the same as or similar to the recess 640. Alternatively, the recess 1130 may form part of the carrier 1150. More descriptions of the target assembly 1100 may be found elsewhere in the present disclosure. See, e.g., FIGS. 15 to 19 and the description thereof.

The carrier 1150 may provide mechanical and/or functional support to the target assembly 1100. The body of the carrier 1150 and the substrate of the target assembly 1100 may be made of a same material or different materials. The carrier 1150 may include one or more passages 1170. The one or more passages 1170 and the passage 1120 together may form a conduit for holding a cooling medium. The conduit may have an inlet 1185 and an outlet 1180 for allowing the cooling medium to flow into and flow out of the conduit.

Optionally, the target assembly 1100 may further include at least one connection structure (not shown in FIG. 11) for mounting the target assembly 1100 on the carrier 1150. The connection structure may allow the target assembly 1100 to be detachably mounted on the carrier 1150. Such connection structures may include a bolt, a slot, a screw, a hole, a nut, a block, or the like, or a combination thereof. Alternatively, the target assembly 1100 may be welded together. The target assembly 1100 may include a connection structure to limit the position of the target assembly 1100 on the carrier 1150 for the welding. The target assembly 1100 may further include structures that facilitate the welding process, such as grooves that may facilitate the discharge of the weld spatter.

Optionally, the carrier 1150 may further include a second radiation module configured to generate second radiation. The second radiation module may be the same as or similar to the second radiation module 650, the description of which is not repeated here.

FIGS. 13, 14, and 15 are schematic diagrams illustrating an exemplary target assembly according to some embodiments of the present disclosure. FIG. 13 illustrates a top view of a target assembly 1300, FIG. 14 illustrates a sectional view of the cross-section A-A' of the target assembly 1300, and FIG. 15 illustrates a sectional view of the cross-section B-B' of the target assembly 1300.

The target assembly 1300 may include a core part 1310, an exemplary embodiment of core part 800 as illustrated in FIG. 8 or its variants (e.g., as illustrated in FIGS. 9, 10, 24, and 25). The core part 1310 may include a window 1314 and a target 1312. The window 1314 and the substrate 1320 may form at least part of a hermetically sealed chamber in which the target 1312 is positioned, and a space 1314 within the chamber may be filled with air or air with a reduced content of oxygen.

The target assembly 1300 may include a passage 1320. The passage 1320 may be formed as part of the substrate 1310 and may hold a cooling medium. When the target assembly 1300 is mounted (detachably or non-detachably) on a carrier (e.g., carrier 1150 as illustrated in FIG. 11), the passage 1320 and one or more tubular structures (e.g., passage 1170) of the carrier may form a complete conduit (conduit 1120) for heat transfer. The passage 1320 may be of any shape (e.g., arc, spiral) embedded in the substrate 1310 and/or the carrier 1150 that may facilitate heat transfer.

Optionally, the target assembly 1300 may include a recess 1350 that is the same as or similar to the recess 640 illustrated in FIG. 6. The target assembly 1300 may also include one or more connection structures (not shown in FIG. 13) for mounting the target assembly 1300 on the carrier.

The target assembly 1300 may be of any shape. In some embodiments, the target assembly 1300 may have a shape that is the same as or similar to the one illustrated in FIG. 13 so that the direction and/or position of the target assembly 1300 on the carrier is limited.

FIGS. 16 and 17 are schematic diagrams illustrating an exemplary target assembly according to some embodiments of the present disclosure. FIG. 16 illustrates a sectional view of a target assembly 1600, and FIG. 17 illustrates a sectional view of the target assembly 1600 mounted on a carrier 1700. The target assembly 1600 provides an example of the target assembly 1100 and may have a core part 1610.

The target assembly 1600 may be the same as or similar to the target assembly 1300, except that the target assembly 1600 may lack a tubular structure (e.g., the passage 1330) for holding a cooling medium. Instead, the target assembly 1600 may include a groove 1660. After the target assembly 1600 is mounted on the carrier 1700, the groove 1660 and a surface of the carrier 1700 may form a passage 1720 for holding a cooling medium. The passage 1720 and one or more tubular structures of the carrier 1700 (not shown in FIG. 17) may form a conduit (e.g., conduit 1100) to house the cooling medium for heat transfer.

Optionally, the target assembly 1600 and/or the carrier 1700 may include connection structures for mounting (detachably or non-detachably) the target assembly 1600 on the carrier 1700. For example, the target assembly 1600 may include one or more connection structure 1670, and the carrier 1700 may include one or more connection structure 1730. The one or more connection structures 1670 and/or 1730 may be a screw, a bolt, a slot, a block, a hole, a groove, or the like, or the combination thereof. For example, the connection structures 1670 and/or 1730 may be grooves to facilitate a discharge of weld spatters if the target assembly 1600 and the carrier 1700 are welded together.

FIGS. 18 and 19 are schematic diagrams illustrating an exemplary target assembly mounted on a carrier according to some embodiments of the present disclosure. FIG. 18 illustrates a top view of a target assembly 1800 mounted on a carrier 1850, and FIG. 19 illustrates a sectional view of the cross-section A-A' of the target assembly 1800 mounted on the carrier 1850. The target assembly 1800 and the carrier 1850 together provide an example of the target assembly 340 or the target assembly 600. The target assembly 1800 may include a core part 1810. The target assembly 1800 may be the same as or similar to the target assembly 1100, 1300 or 1600, the descriptions of which are not repeated.

The carrier 1850 may be the same as or similar to the carrier 1150 except that the carrier 1850 may further include a second radiation module 1860 configured to generate a second radiation. In some embodiments, the second radiation module 1860 may be the same as or similar to the second radiation module 650. In some embodiments, the second radiation module 1860 may have a substantially different structure compared to the target assembly 1800 or the core part 1810.

The second radiation module 1860 may be part of the carrier 1850, or a separate structure mounted (detachably or non-detachably) on the carrier 1850. The carrier 1850 may provide mechanical and/or functional support to the second radiation module 1860. The second radiation module 1860 and the first target assembly may share a same cooling conduit or different cooling conduits. In some embodiments, portions of the second radiation module 1860, the carrier 1850, and the target assembly 1800 may contribute to form a complete cooling conduit.

Exemplary techniques for switching between the target assembly 1800 and the second radiation module 1860 are illustrated in FIGS. 20 and 21.

FIGS. 20 and 21 are schematic diagrams illustrating exemplary techniques for switching between a plurality of radiation generation mechanisms. The target assembly 2000 may be a non-detachable or detachable structure including a secondary target assembly and a carrier. Examples of such a structure may be found elsewhere in the present disclosure. See, e.g., FIGS. 6, 7, 11, 12, 18, and 19 and the description thereof.

The target assembly 2000 may include a first radiation generation mechanism 2011 and a second radiation generation mechanism 2012 (e.g., the core parts 800, 900, and 1000, the target assemblies 1100, 1300, 1600, and 1800, the second radiation modules 650 and 1860). When impinged by a beam 2010, the first radiation generation mechanism 2011 may generate first radiation 2121, and the second radiation generation mechanism 2012 may generate second radiation 2022. The first radiation generation mechanism 2011 and/or the second radiation generation mechanism 2012 may be part of the target assembly 2000, or be detachably or non-detachably mounted on a carrier to form the target assembly 2000. Additional radiation generation mechanisms may also be included in the target assembly 2000.

The first radiation and the second radiation may be different in frequency and/or intensity. For example, the first radiation 2021 may be a normal X-ray and the second radiation 2022 may a high-energy X-ray. As another example, the first radiation 2021 and the second radiation 2022 may both be X-rays but of different intensities. By switching the radiation generation mechanism that receives the beam 2010, the generated radiation may change between the first radiation 2021 and the second radiation 2022.

In some embodiments, as shown in FIG. 9, the target assembly 2000 (or a carrier on which the target assembly 2000 is amounted) may be movable so that different radiation generation mechanisms may be positioned in the propagation path (beam path) of the beam 2010. When the first radiation generation mechanism 2011 is positioned in the beam path, the first radiation 2021 may be generated. When the second radiation generation mechanism 2012 is positioned in the beam path, the second radiation 2022 may be generated. The moving of the target assembly 2000 may be driven by a motor or manually.

In some embodiments, as shown in FIG. 21, the beam path of the beam 2010 may be switchable. A beam path switching mechanism 2030 may be configured in the beam path of the beam 2010 so that the downstream beam path may be selected between a first path 2031 and a second path 2032. The beam 2010 may reach the first radiation generation mechanism 2011 when propagating along the first path 2031 and the first radiation 2021 may be generated. The beam 2010 may reach the second radiation generation mechanism 2012 when propagating along the second path 2032 and the second radiation 2022 may be generated.

The beam path switching mechanism 2030 may include any suitable components for shaping and/or directing the beam 2010 so that it may propagate along the first path 2031 and the second path 2032. These components may include, e.g., a magnet, a collimator, a mirror, a lens (e.g., condenser lens), a filter, an electromagnetic field generator, or the like, or a combination thereof. The materials, sizes, shapes, and/or properties of these components may be adapted to the nature of the beam 2010.

In some embodiments, the target assembly 2000 may be an exemplary embodiment of the target assembly 341 and be installed on the radiation generator 300 (e.g., as illustrated in FIG. 3). The beam 2010 may be an electron beam generated by the electron source 310 and the waveguide 320, or a beam of another type generated by a corresponding beam generator. The radiation generator 300 may have a plurality of radiation modes including, e.g., a first radiation mode for generating the first radiation 2021 and a second radiation mode for generating the second radiation 2022. In the first radiation mode, the first radiation generation mechanism 2011 may receive the beam. In the second radiation mode, the second radiation generation mechanism 2012 may receive the beam. By switching the radiation mode (e.g., in response to an instruction provided by a user or based on a digital radiation plan pre-stored in the storage device 150), the radiation generator 300 may generate a desired radiation.

In some embodiments, the radiation generator 300 may adopt the switching mechanism as illustrated in FIG. 20. The radiation generator 300 may further include a servo motor to effectuate the movement of a movable target assembly 2000 to switch radiation modes.

In some embodiments, the radiation generator 300 may adopt the switching mechanism as illustrated in FIG. 21. The beam director 360 may include the beam path switching mechanism 2030 to perform the switching of radiation modes. Optionally, the radiation generator 300 may further include one or more shaping components to shape and/or redirect the generated radiations so that they may have a same or substantially same focal point.

It should be noted that the radiation generator 300 may also adopt other mechanisms for switching radiation modes. The radiation generation switching techniques described herein are only for demonstration purposes and are not intended to be limiting. For example, the radiation generator 300 may have a first beam generator for generating a first beam and a second beam generator for generating a second beam. The first beam may propagate along a first path and be received by the first radiation mechanism 2011, and the second beam may propagate along a second path and be received by the second radiation mechanism 2012.

FIG. 22 is a schematic diagram illustrating an exemplary radiation generator including a target assembly according to some embodiments of the present disclosure. The radiation generator 2200 may be configured to generate radiation (e.g., radiation 2290). The radiation generator 2200 may have a configuration of a tube as illustrated in FIG. 22. The radiation generator 2200 may include an electron source 2210, a housing 2230, a target assembly 2240, and a cooling conduit 2250. The electron source 2210 and the target assembly 2240 may be positioned inside the housing 2230, which may be vacuum or substantially vacuum.

The electron source 2210 may serve as a cathode and emit electrons. For example, the election source 2210 may be a filament made of tungsten or an alloy of tungsten The target assembly 2240 may have a core part that is the same as or similar to the core part 800, 900, or 1000 as illustrated in FIGS. 8-10. A target or a functional plate of the target assembly may serve as an anode set to a high positive voltage with respect to the cathode (the electron source 2210). Electrons emitted from the cathode may then be accelerated towards the anode by an electrostatic force, and generate radiation 2290 at the target.

The cooling tube 2250 may hold a cooling medium (e.g., water, air, oil). The cooling tube 2250 may include an inlet 2251 and an outlet 2252 for allowing the cooling media to flow in and flow out. The heat generated by the target during radiation generation may be transferred to the cooling medium. A cooling unit (e.g., included in the radiation apparatus 110) may deliver the used cooling medium to the cooling tube to be cooled for reuse.

In some embodiments, the radiation generator 2200 may be an X-ray tube and the radiation 2290 may be X-rays. The target of the target assembly may be made of tungsten or an alloy of tungsten.

FIG. 23 is a schematic diagram illustrating an exemplary process for assembling a target assembly according to some embodiments of the present disclosure. For simplicity, only the assembling of a core part the same as or similar to the core parts 800 (as shown in FIG. 8) is described in connection with FIG. 23. The assembling of other embodiments of the core part 800 (e.g., as shown in FIGS. 9, 10, 23, and 24) may be performed in a similar manner.

The process may include providing a substrate 2310. The substrate 2310 may be provided with a cavity 2311 (e.g., by molding or drilling). The substrate 2310 may correspond to the substrate 810, 910, or 1010 and may have a sufficient mechanical intensity and heat conductivity (e.g., copper made). The provided substrate may also have one or more other functional parts including, e.g., the conduit 630, the tube 1120 or 1330, the recess 640 or 1350, the groove 1660, connection structures for connecting the substrate with a carrier (e.g., carrier 1150 or 1850), etc. The cavity 2311 may penetrate a portion of or the entire depth of the substrate 2310. In some embodiments, the cavity 2311 may penetrate a portion of the depth of the substrate 2310, and the cavity 2311 may have a bottom 2312 formed by a part of the substrate 2310. In some embodiments, the cavity 2311 may penetrate the entire depth of the substrate, and a functional plate (e.g., the functional plate 1050 as illustrated in FIG. 10) may be positioned within or at the bottom of the cavity 2311 to seal the cavity 2311 and serve as the bottom 2312.

The process may also include positioning a target plate 2320 on the substrate. The substrate may be positioned in the cavity 2311. The target plate 2320 may be the same as or similar to the target 830, 930 or 1030, and configured to generate radiation when impinged by an electron beam (e.g., a tungsten plate). In some embodiments, the target plate 2320 may be attached on the bottom 2312. In some embodiments, the target plate 2320 may be attached on a functional plate (e.g., the functional plate 950 or 1050 as illustrated in FIGS. 9 and 10), and the process may further include positioning the functional plate into the cavity 2311.

The process may further include installing a window plate 2330 onto the substrate 2310 to build a preliminary target assembly 2350 under the prevailing environmental condition. The window plate 2330 may be at least partially permeable to the electron beam (e.g., a beryllium plate). In some embodiments, the installation of the window plate 2330 may be performed at the prevailing environmental condition (e.g., under the prevailing atmospheric pressure without vacuuming air). The window plate 2330 and the substrate 2310 may then be, for example, welded together to form at least part of a hermetically sealed chamber, and a space 2340 within the chamber may contain ambient air.

In some embodiments, the prevailing environmental condition may be similar to the standard temperature and pressure (STP).

In some embodiments, the window plate 2330 and the cavity 2311 may form the hermetically sealed chamber. Alternatively, the window plate 2330, the cavity 2311 and the aforementioned functional plate may together form the hermetically sealed chamber.

Optionally, the process may further include conditioning of the preliminary target assembly 2350. Through the conditioning, the preliminary target assembly 2350 may be conditioned to its typical operating condition (defined by, e.g., a working temperature, a working pressure) and form the final target assembly 2360. The conditioning of the preliminary target assembly 2350 may include heating the preliminary target assembly to a temperature approximate to an intended working temperature of the target assembly. For example, in some embodiments, the target 2320 may be tungsten and may generate X-rays when impinged by an electron beam, and the working temperature of the target assembly may be over 1100 degrees Celsius. The heating may be performed for a period sufficient to condition the preliminary target assembly 2350.

During the conditioning or heating of the preliminary target assembly 2350, according to the equilibrium equation as illustrated by Equation (1), oxygen may be consumed and the internal pressure of the hermetically sealed chamber may be altered. The curvature of the window plate 2330 and the size of the space 2340 may change accordingly. For example, if the window plate 2330 is ease to be bent (due to material, size, shape, etc., of the window plate 2330), and/or the prevailing pressure applied during the sealing process is relatively low, the window plate 2330 may curve towards the substrate 2310 and the size of the space 2340 may be reduced, which may cause the melting of the window plate 2330 and an increase in the chances of a thermomechanical shock experienced by the window plate 2330.

Various techniques may be adopted to ascertain that the curvature of the window plate 2330 and/or the size of the space 2340 are within an acceptable limit, some of them are described as following for demonstration purposes.

In some embodiments, the window plate 2330 may be curved away from the substrate 2310 while the cavity 2311 is being sealed. For example, the curving or bending of the window plate 2320 may be implemented by applying a negative pressure (with respect to the prevailing environmental condition) to the outside surface of the window plate 2320. The negative pressure may be optimized so that the window plate 2330 of the final target assembly may have an acceptable curvature.

In some embodiments, the prevailing environmental condition (e.g., the external pressure, temperature) for sealing the cavity 2311 may be optimized by iteratively performing the sealing and conditioning. For example, several preliminary target assemblies 2350 may be fabricated with different values of the external pressure, and the optimal pressure may be chosen based on the final curvatures or shapes of the window plates after the conditioning process is complete.

In some embodiments, the pressure inside the chamber at the time of sealing may be increased above the STP (e.g., by adjusting the prevailing environmental condition) so that the window plate 2330 may be deflected outward when the target assembly 2360 is operated at or nearer the STP.

Optionally, the method may also include positioning a functional plate (e.g., the functional plate 950 and/or 1050) in the cavity 2311. This operation may be performed before or after the positioning of the target plate 2320.

It may be noted that, the substrate 2310 may be configured without the cavity 2311. For assembling a core part without a cavity (e.g., as shown in FIGS. 24 and 25), the target 2320 may be attached directly onto a surface of the substrate 2310, or onto a functional plate that is positioned on a surface of the substrate. The window 2330 (e.g., a cup-shaped or domelike structure) may then be installed on the substrate 2310, which may cover the target 2320 and any possible functional plate. The window 2330 may then be sealed (e.g., through welding) onto the substrate 2310 to form a hermetically sealed chamber.

FIGS. 24 and 25 are schematic diagrams illustrating exemplary core parts of target assemblies according to some embodiments of the present disclosure. The core part 2400 may include a substrate 2410, a window 2420, a target 2430, and a space 2440. Optionally, the core part 2400 may further include one or more functional plates (e.g., functional plates 950).

The substrate 2410, the window 2420, the target 2430, and the space 2440 may be the same as or similar to the substrate 810, the window 820, the target 830, and the space 840, the descriptions of which are not repeated here. The substrate 2410 may be configured without a cavity for holding the target 2430. Instead, the window 2420 may provide a space for holding the target 2430 and/or any other functional plates (if any). For example, the window 2420 may be a domelike or cup-like structure. The substrate 2410 and the window 2420 may form a hermetically sealed chamber, and the space 2440 inside the chamber may be filled with air having a normal or reduced content of oxygen.

The core part 2500 may include a substrate 2510, a window 2520, a target 2530, and a space 2540. The substrate 2510, the window 2520, the target 2530, and the space 2540 may be the same as or similar to the substrate 2410, the window 2420, the target 2430, and the space 2440, the descriptions of which are not repeated here. A portion of the target 2530 may extend out of a hermetically sealed chamber formed by the window 2520 and the substrate 2510. Alternatively, it may be viewed that, the substrate 2510, the window 2520, and a portion of the target 2530 may together form a hermetically sealed chamber in which a portion of the target 2530 is enclosed.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer readable media having computer readable program code embodied thereon.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purposes, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, for example, an installation on an existing server or mobile device.

Similarly, it should be appreciated that in the foregoing description of embodiments of the present disclosure, various features are sometimes grouped together in a single embodiment, figure, or description thereof for the purposes of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and describe.

What is claimed is:

1. A method for manufacturing a target assembly, comprising:

providing a substrate;

positioning a target on the substrate, wherein the target plate is capable of generating radiation when impinged by a beam;

installing a window plate onto the substrate under the atmospheric air to build a preliminary target assembly, wherein the window plate and the substrate forms at least part of a hermetically sealed chamber and the window plate is at least partially permeable to the beam; and heating the preliminary target assembly to a temperature approximate to a proposed working temperature of the target assembly.

2. The method of claim 1, the installing the window plate onto the substrate under the atmospheric air including:

causing the window plate to curve away from the substrate; and installing the curved window plate onto the substrate under a prevailing environmental condition, wherein the chamber formed by the window plate and the cavity contains ambient air.

3. The method of claim 2, the causing the window plate to curve away from the substrate including:

applying a negative pressure to a surface of the window plate.

4. The method of claim 2, wherein the prevailing environmental condition is approximate to the standard temperature and pressure.

5. The method of claim 1, wherein the proposed working temperature of the target assembly is over 1100 degrees Celsius.

6. The method of claim 1, wherein the installing of the window plate is without vacuuming air.

* * * * *